US008251021B1

(12) United States Patent
Corbett, Jr.

(10) Patent No.: US 8,251,021 B1
(45) Date of Patent: Aug. 28, 2012

(54) HYDRONIC ASSEMBLY OF MANIFOLD WITH HYDRAULIC SEPARATOR AND ENDSUCTION PUMPS

(75) Inventor: A. Hoyt Corbett, Jr., Bainbridge Island, WA (US)

(73) Assignee: Inventive Development LLC

( * ) Notice: Subject to any disclaimer, the term of this patent is extended or adjusted under 35 U.S.C. 154(b) by 1504 days.

(21) Appl. No.: 11/701,990

(22) Filed: Feb. 2, 2007

(51) Int. Cl.
*F22B 37/26* (2006.01)

(52) U.S. Cl. ..... 122/235.15; 237/59; 237/63; 237/56

(58) Field of Classification Search ..... 237/56, 237/59, 63, 69; 122/235.15; 137/561 A
See application file for complete search history.

(56) References Cited

U.S. PATENT DOCUMENTS

| | | | | |
|---|---|---|---|---|
| 2,652,069 | A * | 9/1953 | Goheen | 137/271 |
| 2,823,695 | A | 2/1958 | Coffin | |
| 2,878,651 | A | 3/1959 | Heinzelman | |
| 4,498,623 | A * | 2/1985 | Rodd | 237/8 R |
| 4,564,142 | A * | 1/1986 | Cleer, Jr. | 237/8 R |
| 4,770,341 | A | 9/1988 | Drake | |
| 4,907,739 | A | 3/1990 | Drake | |
| 5,022,459 | A | 6/1991 | Chiles et al. | |
| 5,111,875 | A | 5/1992 | Hammarstedt | |
| 5,316,384 | A * | 5/1994 | Corso | 366/338 |
| 5,390,660 | A | 2/1995 | Danielson | |
| 5,474,102 | A * | 12/1995 | Lopez | 137/271 |
| 5,950,575 | A * | 9/1999 | Simons et al. | 122/511 |
| 6,062,308 | A * | 5/2000 | Flood | 166/52 |
| 6,092,734 | A * | 7/2000 | Rea | 237/8 R |
| 6,345,770 | B1 * | 2/2002 | Simensen | 237/69 |
| 6,347,748 | B1 | 2/2002 | Lyons | |
| 7,117,888 | B2 * | 10/2006 | Niekolaas | 137/561 A |
| 7,191,789 | B2 | 3/2007 | Corbett | |
| 7,509,927 | B2 * | 3/2009 | Mukomilow | 122/235.15 |

FOREIGN PATENT DOCUMENTS

| | | | |
|---|---|---|---|
| DE | 3533460 | A1 * | 3/1987 |
| DE | 4442281 | A1 * | 5/1996 |
| EP | 1396686 | A2 * | 3/2004 |
| FR | 2852672 | A1 * | 9/2004 |

OTHER PUBLICATIONS

Bell & Gossett—ITT Industries, Inc., Installation, Operation and Service Instructions for Series 60 In-Line Centrifugal Pumps, pp. 1-8, dated Nov. 1999.*

Bell & Gossett, ITT Industries Inc., Installation, Operation, and Service Instructions for Series 60 In-Line Centrifugal Pumps, pp. 1-8, Dated Nov. 1999.*

Hydraulic Separation: New Methods of Implementing an Established Concept; Technical Jomal from Caleffi Hydronic Solutions; Jan. 2007; pp. 3-19.

* cited by examiner

*Primary Examiner* — Gregory A Wilson
(74) *Attorney, Agent, or Firm* — Jeffrey T. Haley

(57) ABSTRACT

An air elimination device with a hydraulic separator in a compact format that eliminates numerous separate field installed components and connections and can be cost effectively made by means of spun, bent, bored, milled sheet copper or brass sheet, copper or brass tube or rod utilizing brazing, soldering and threading of parts. The device can be made to include a manifold, particularly with compact end suction pumps and can serve as a transition adaptor to other modular mechanical components.

21 Claims, 26 Drawing Sheets

Figure 1:
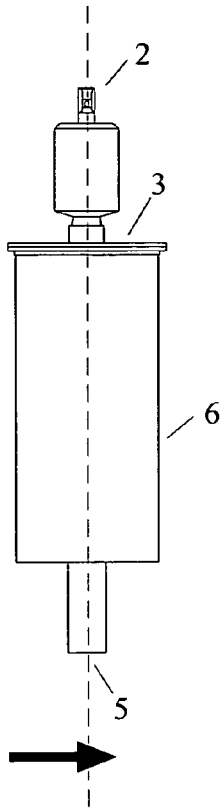
Figure 1:
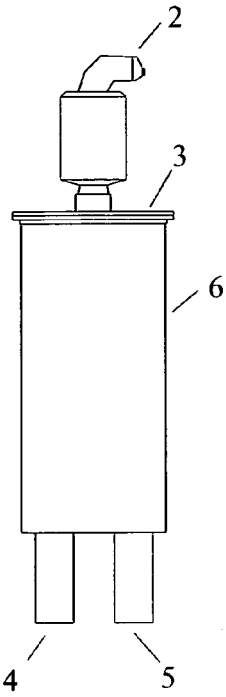
Figure 1:
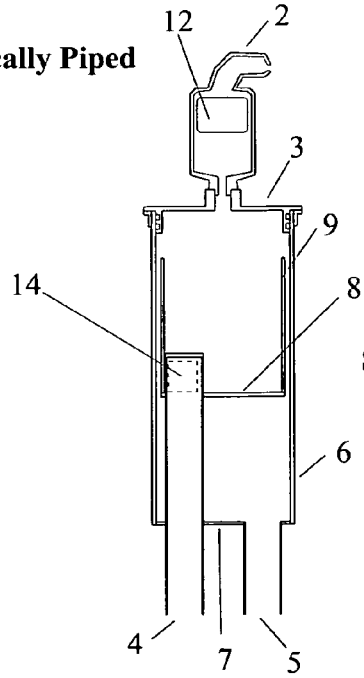
Figure 2:
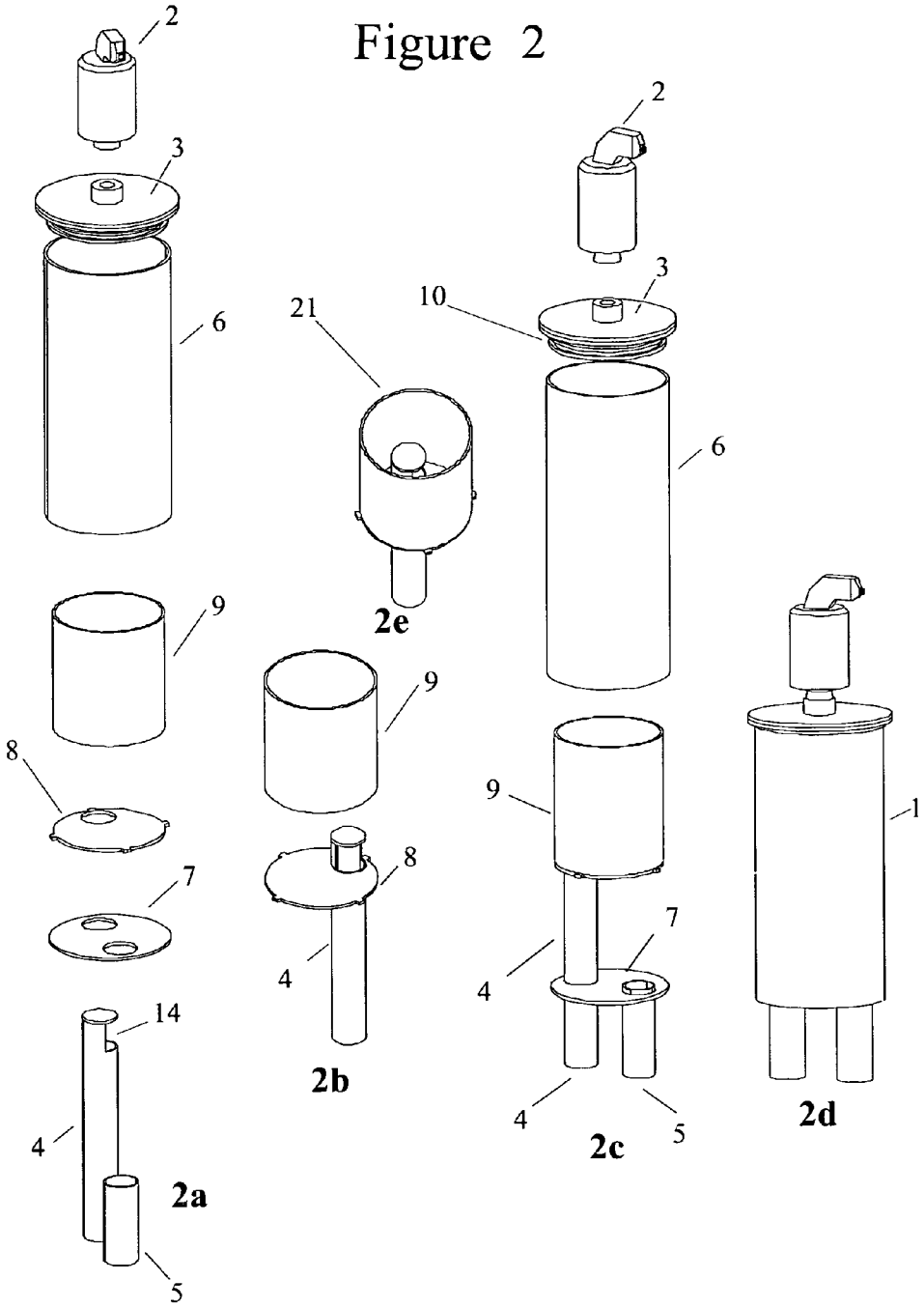
Figure 3:
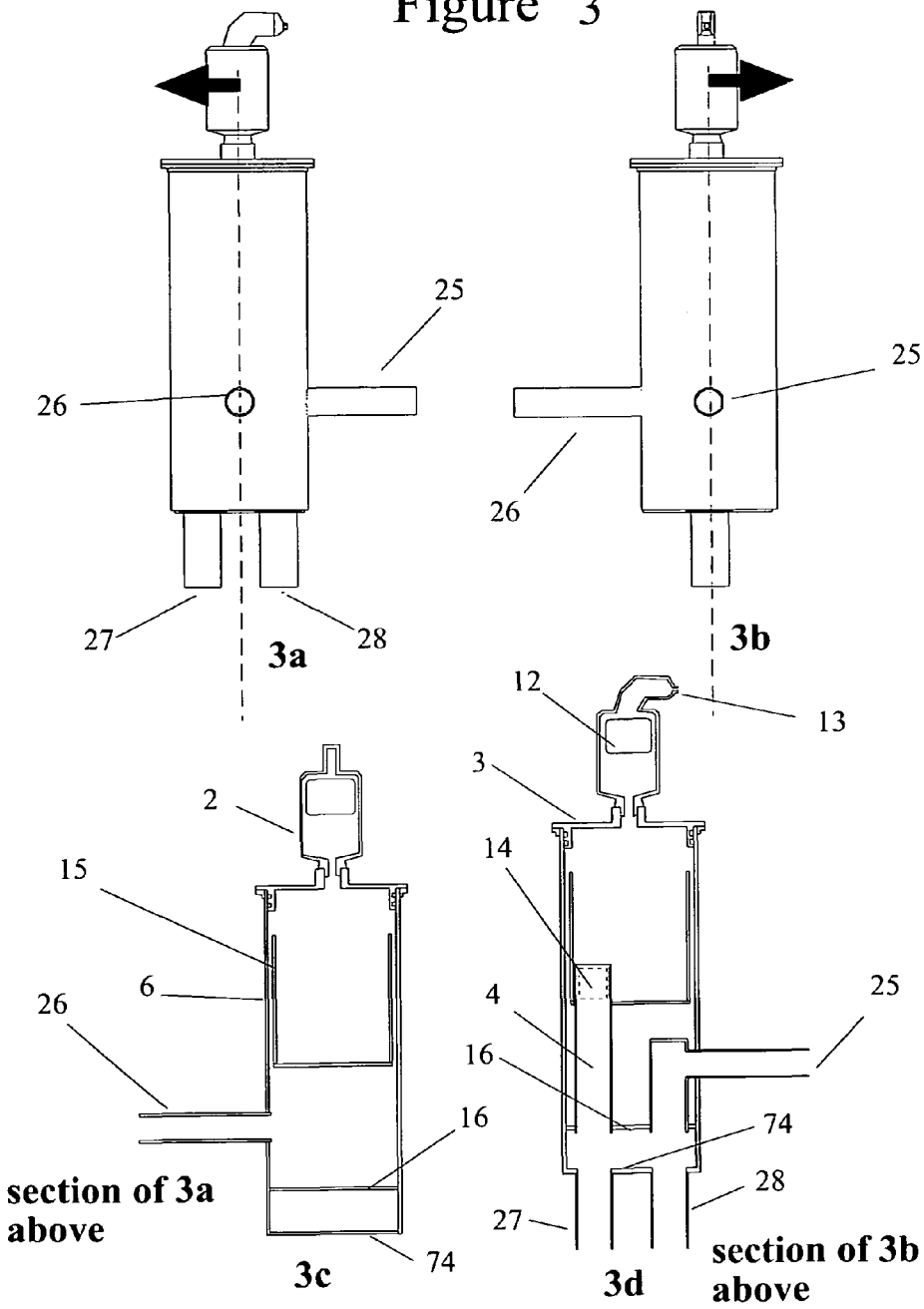
Figure 4:
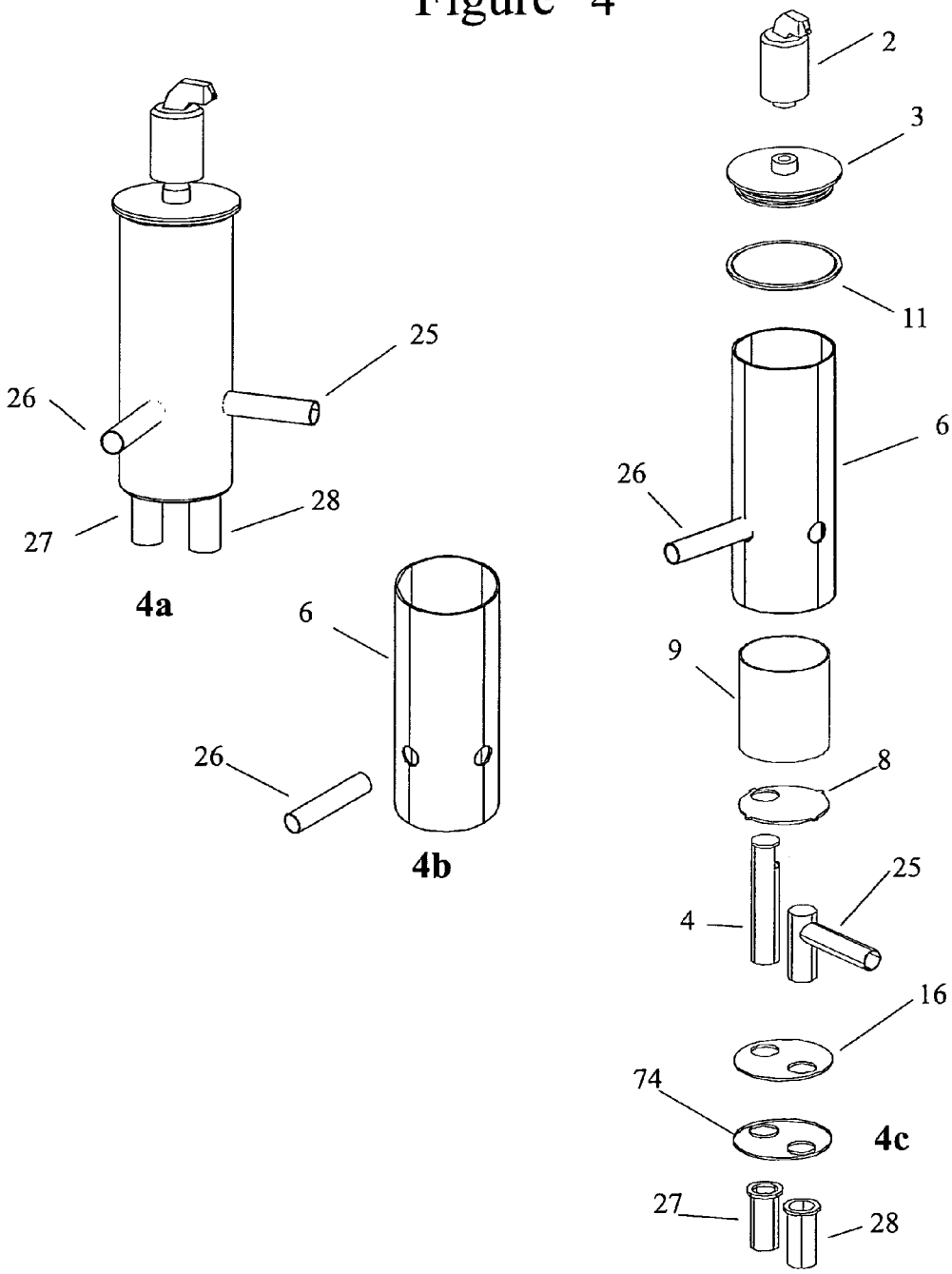
Figure 5:
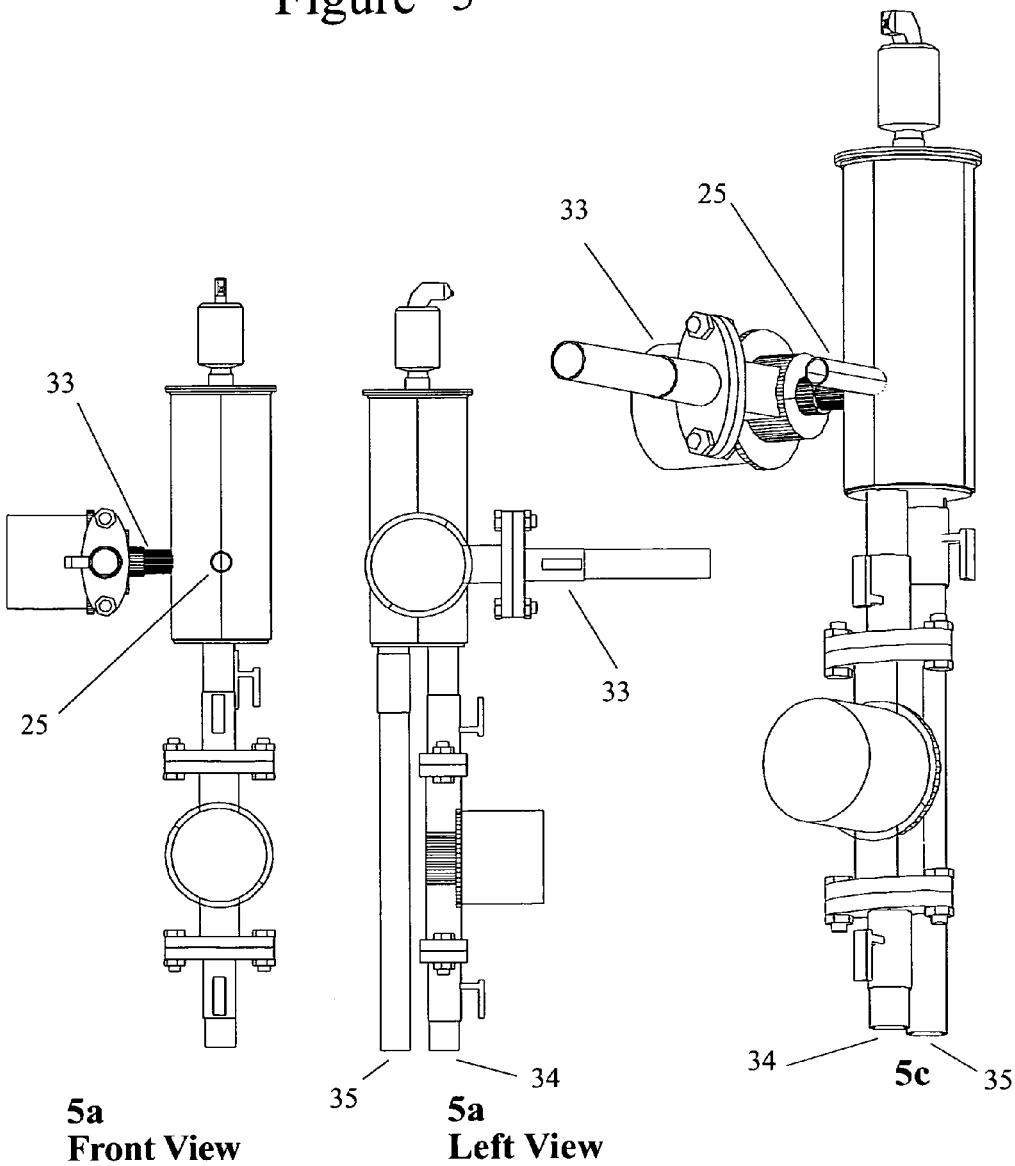
Figure 6:
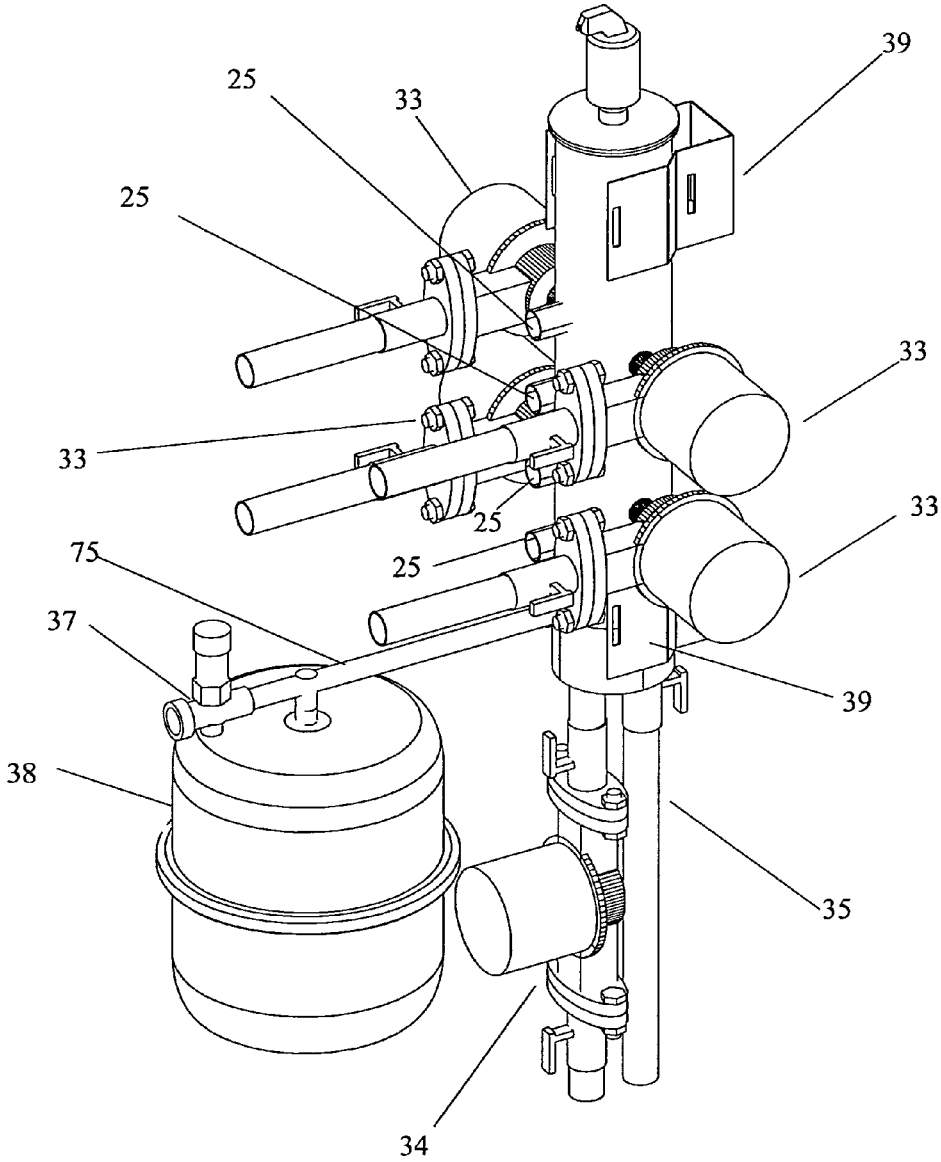
Figure 7:
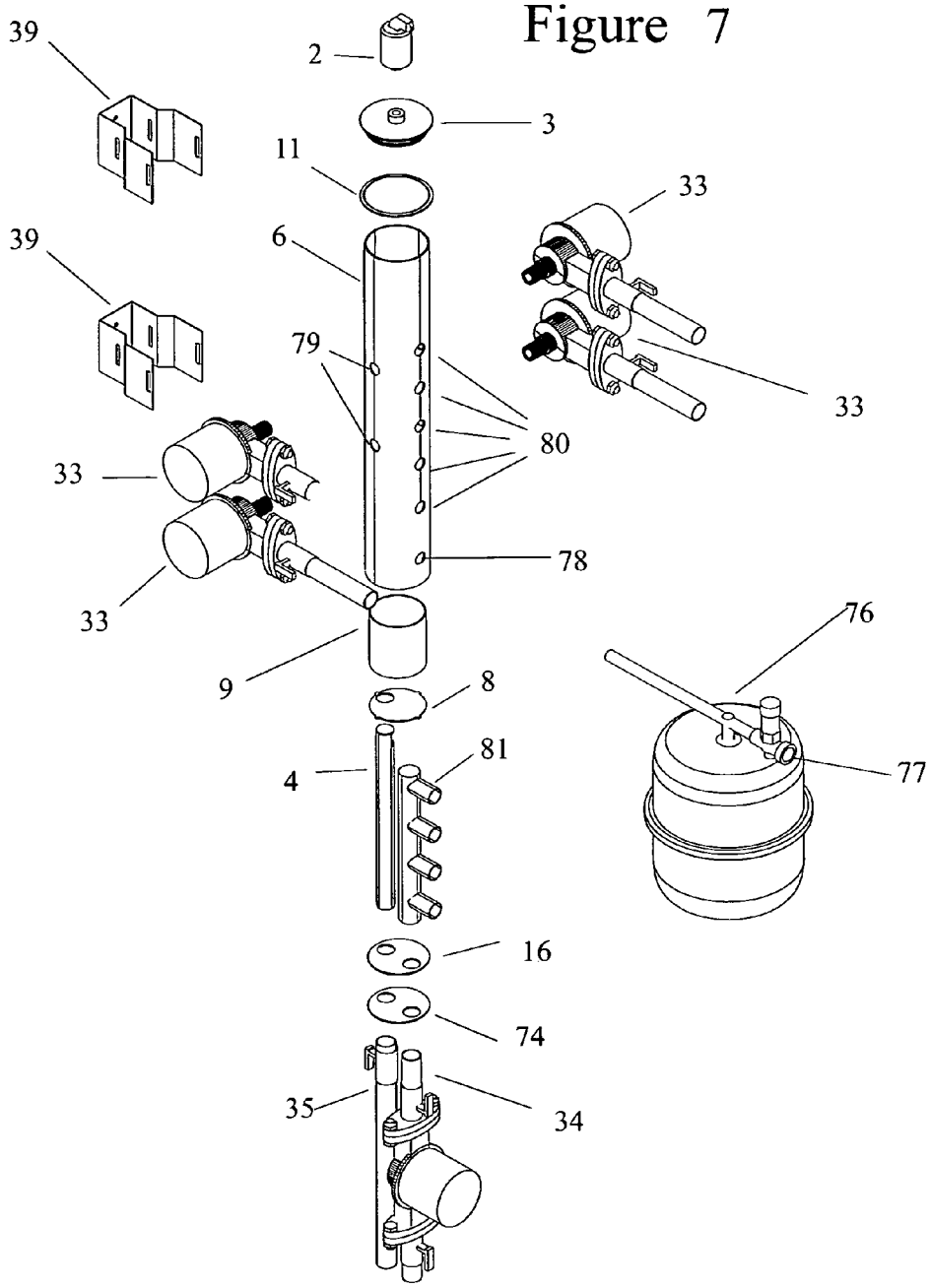
Figure 8:
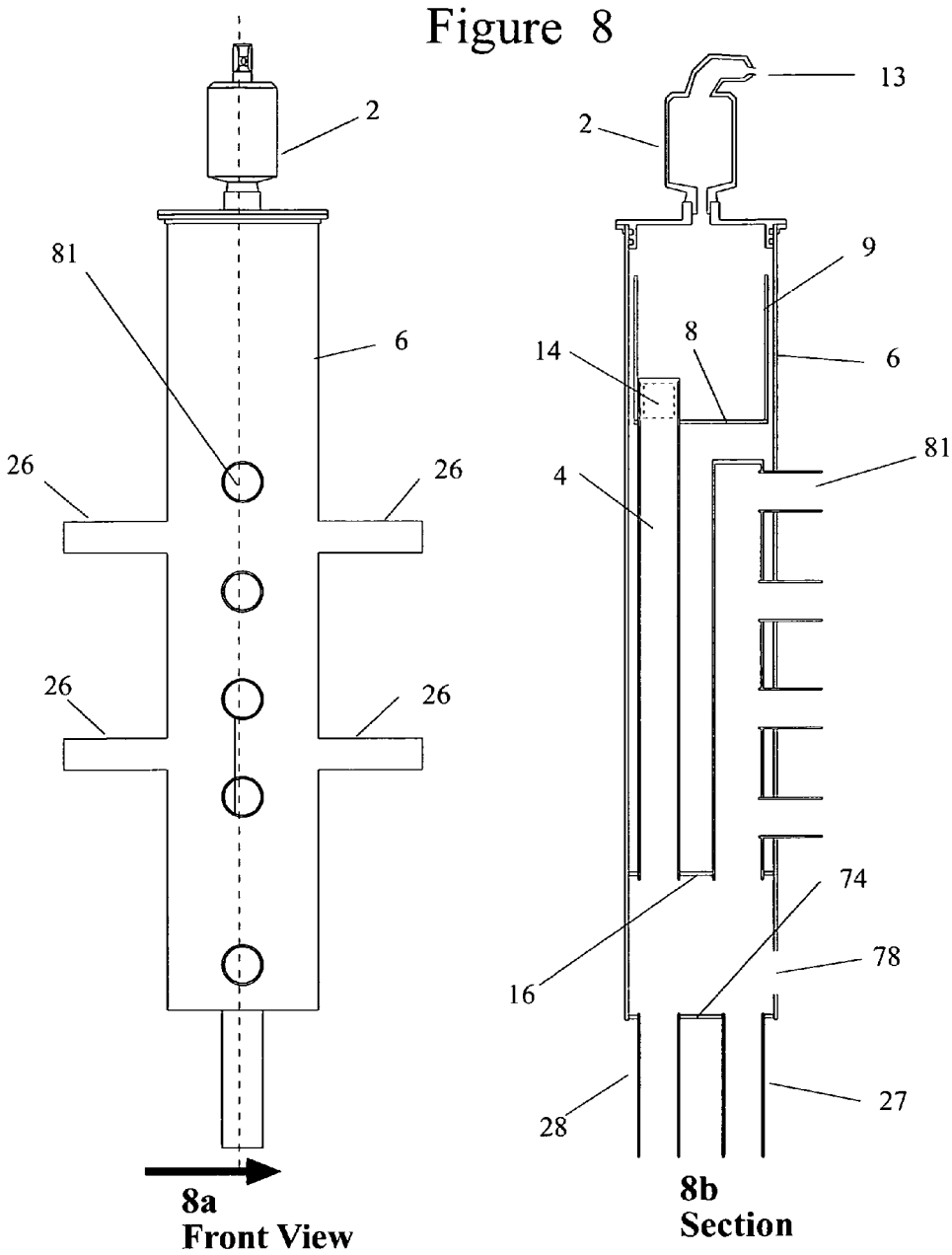
Figure 9:
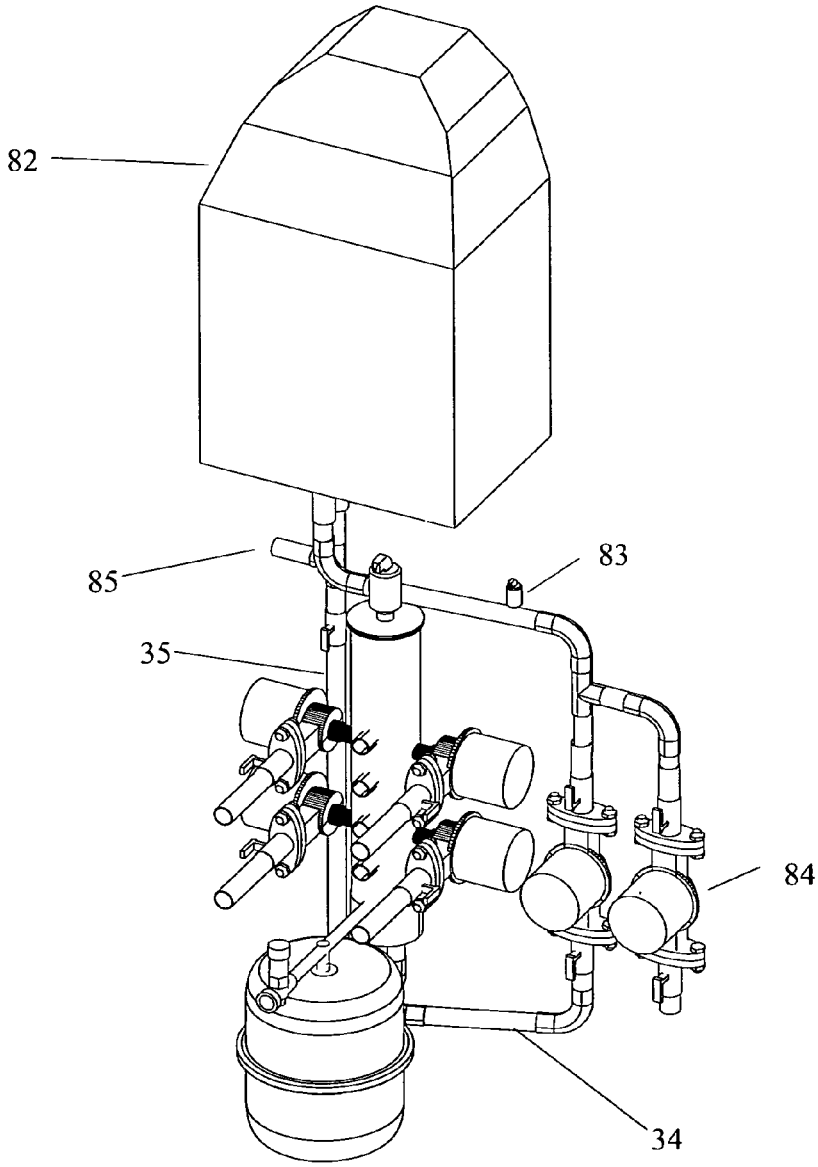
Figure 10:
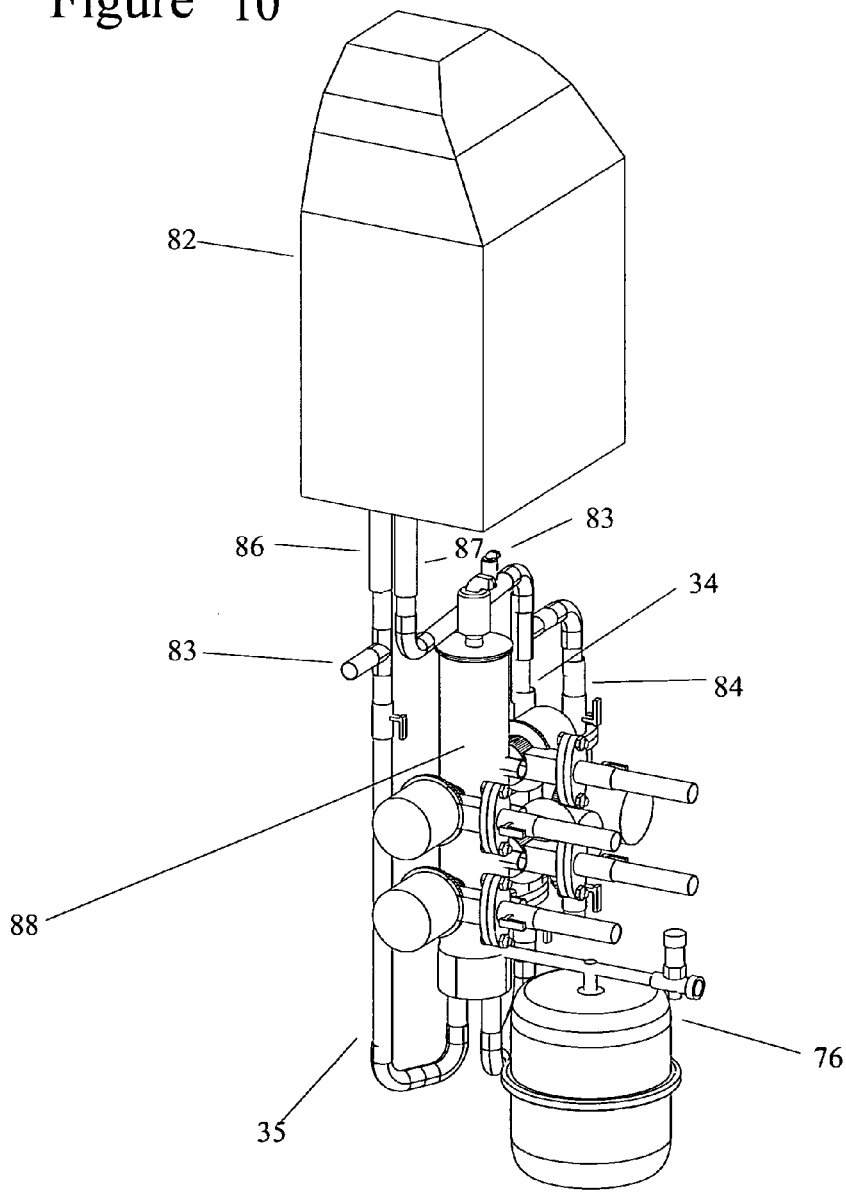
Figure 11:
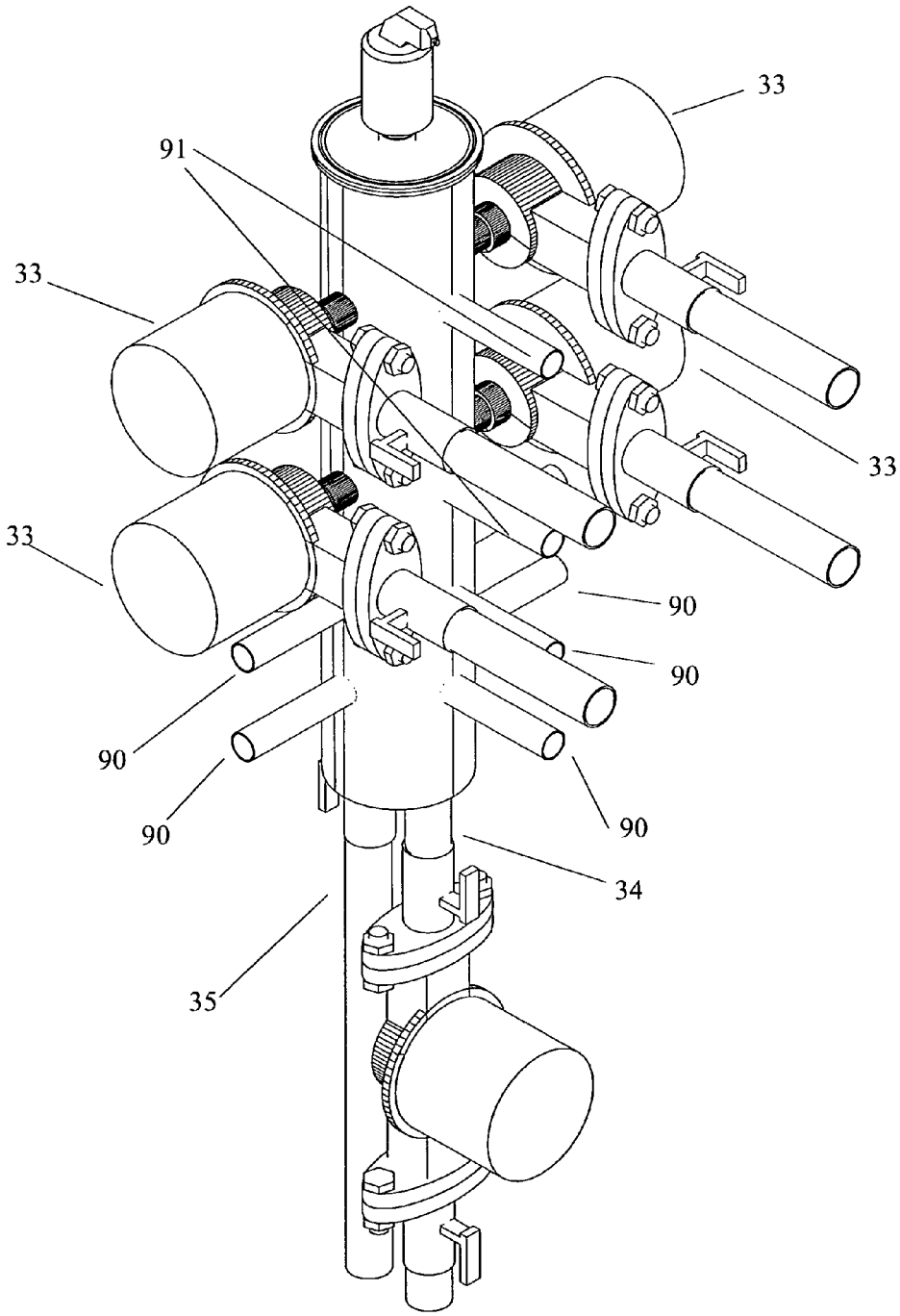
Figure 12:
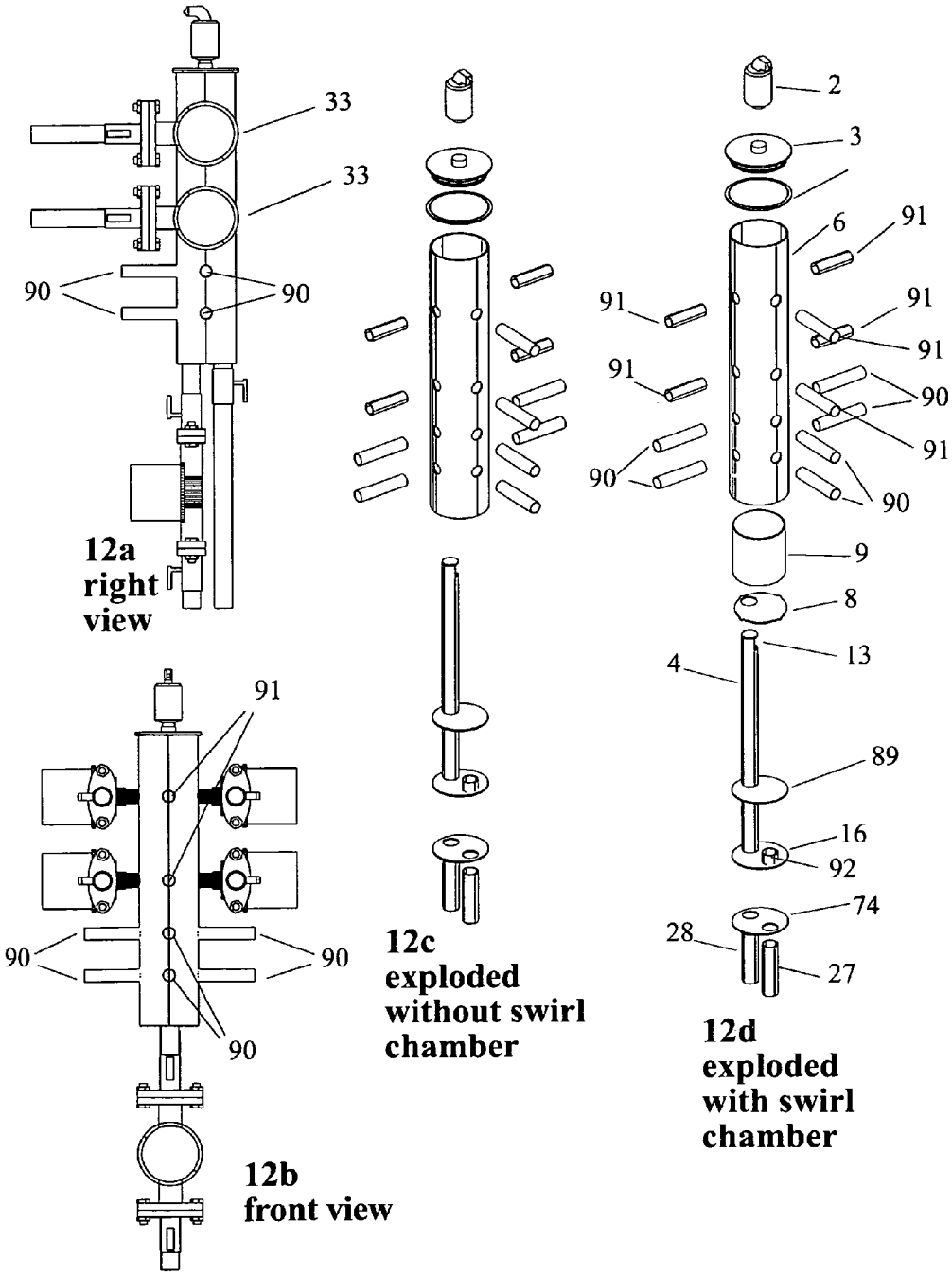
Figure 13:
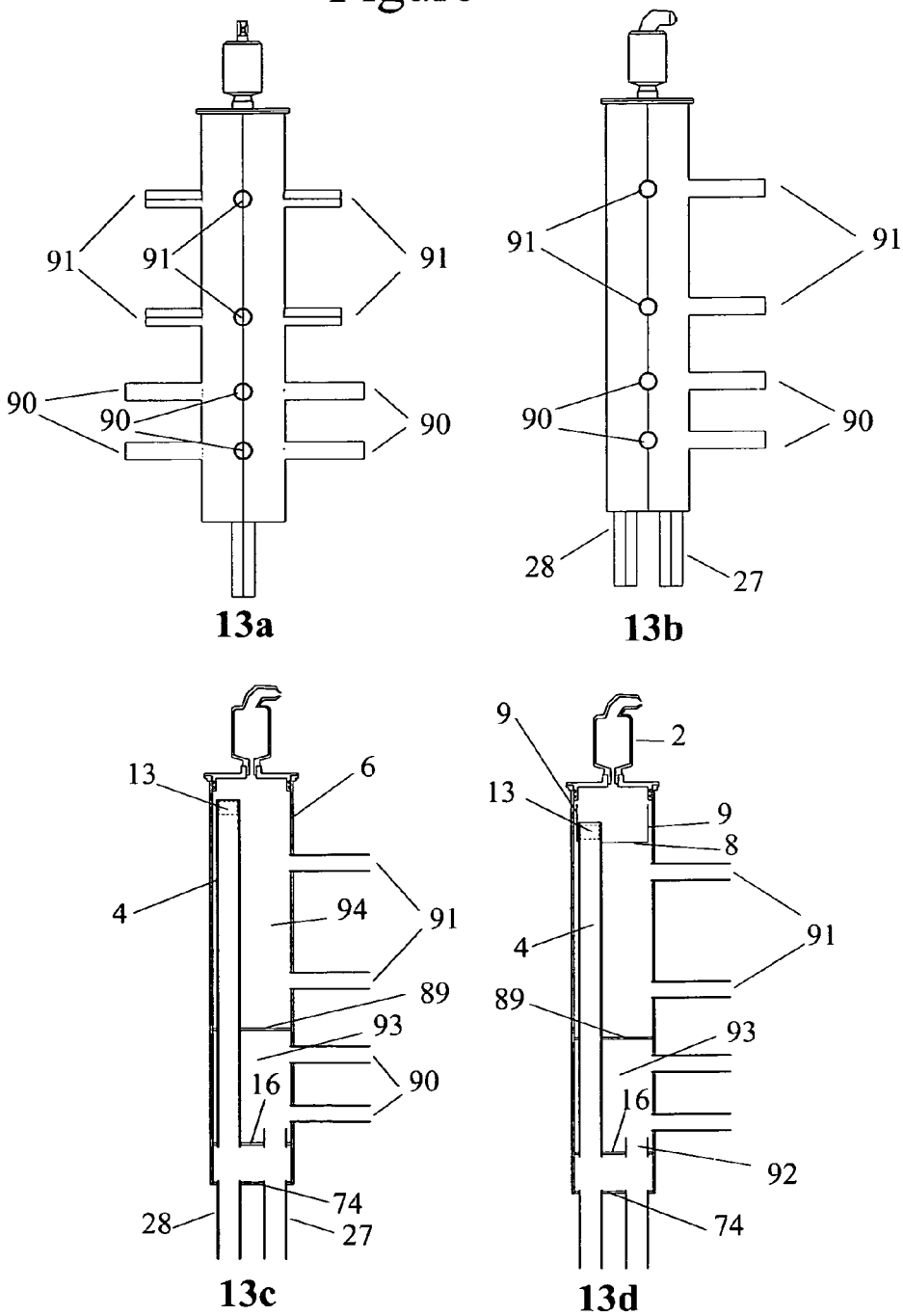
Figure 14:
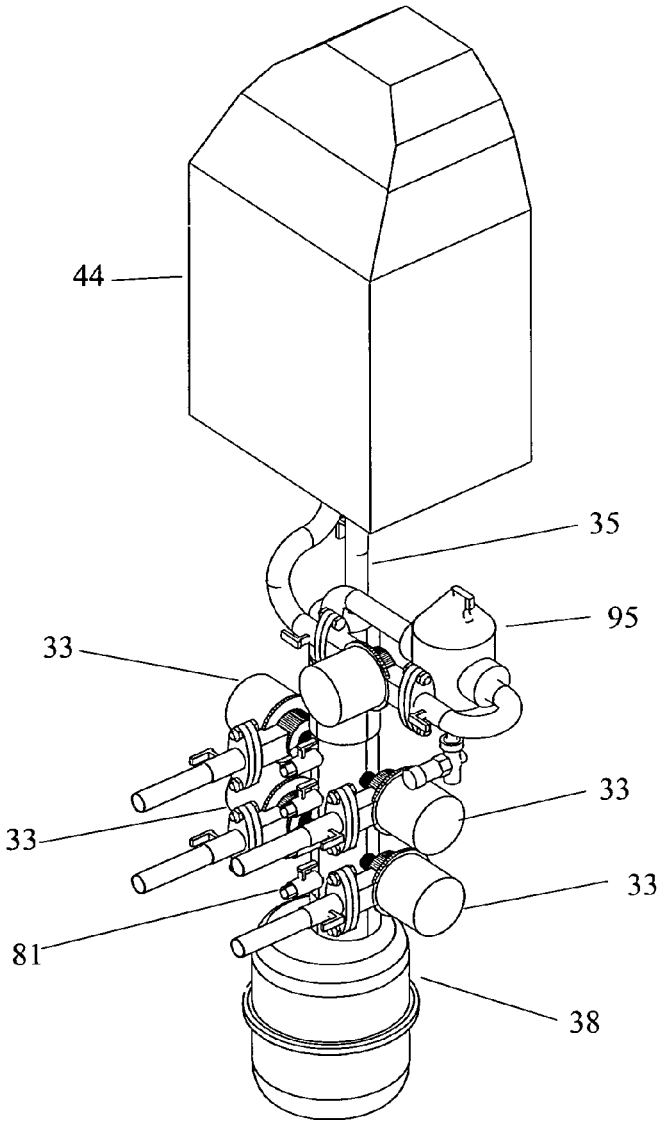
Figure 15:
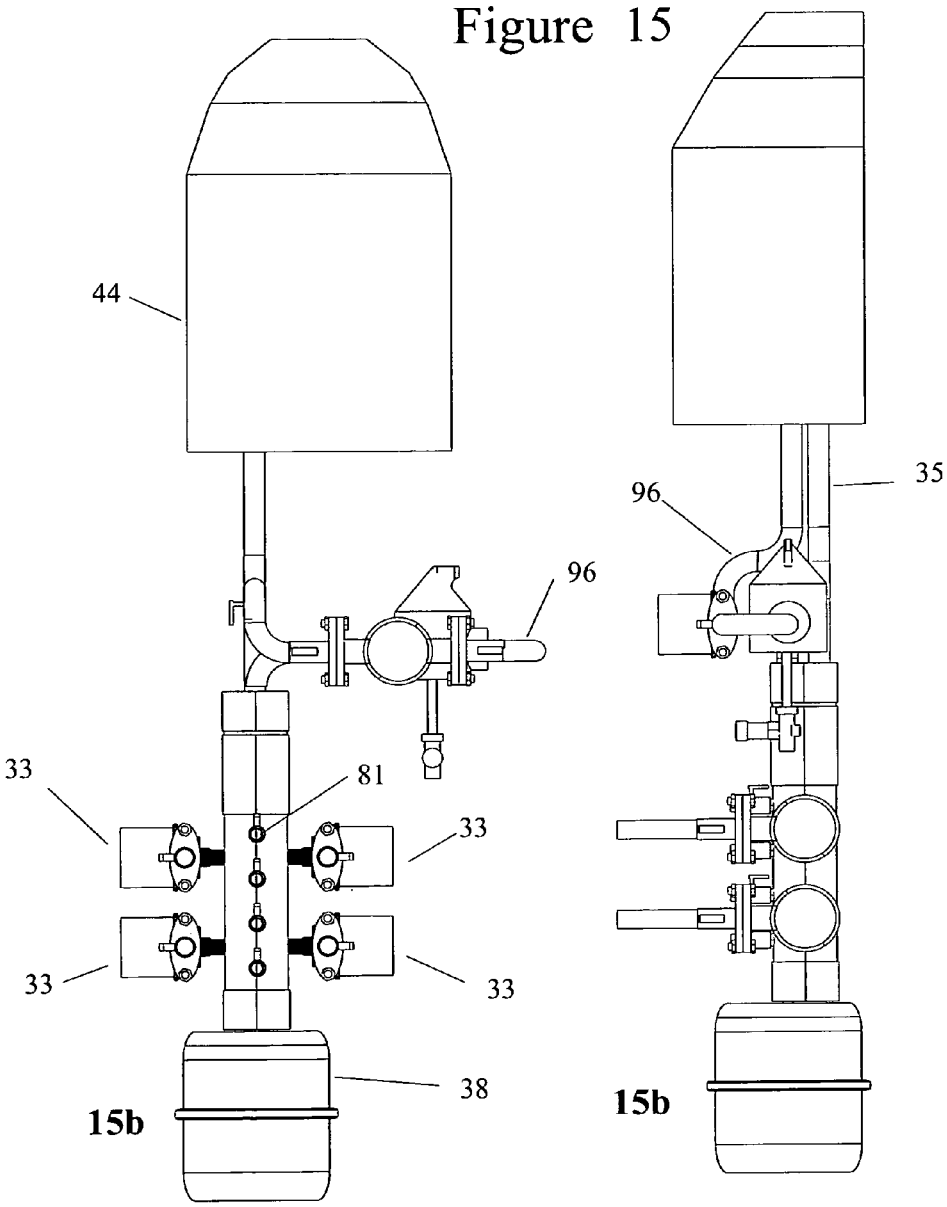
Figure 16:
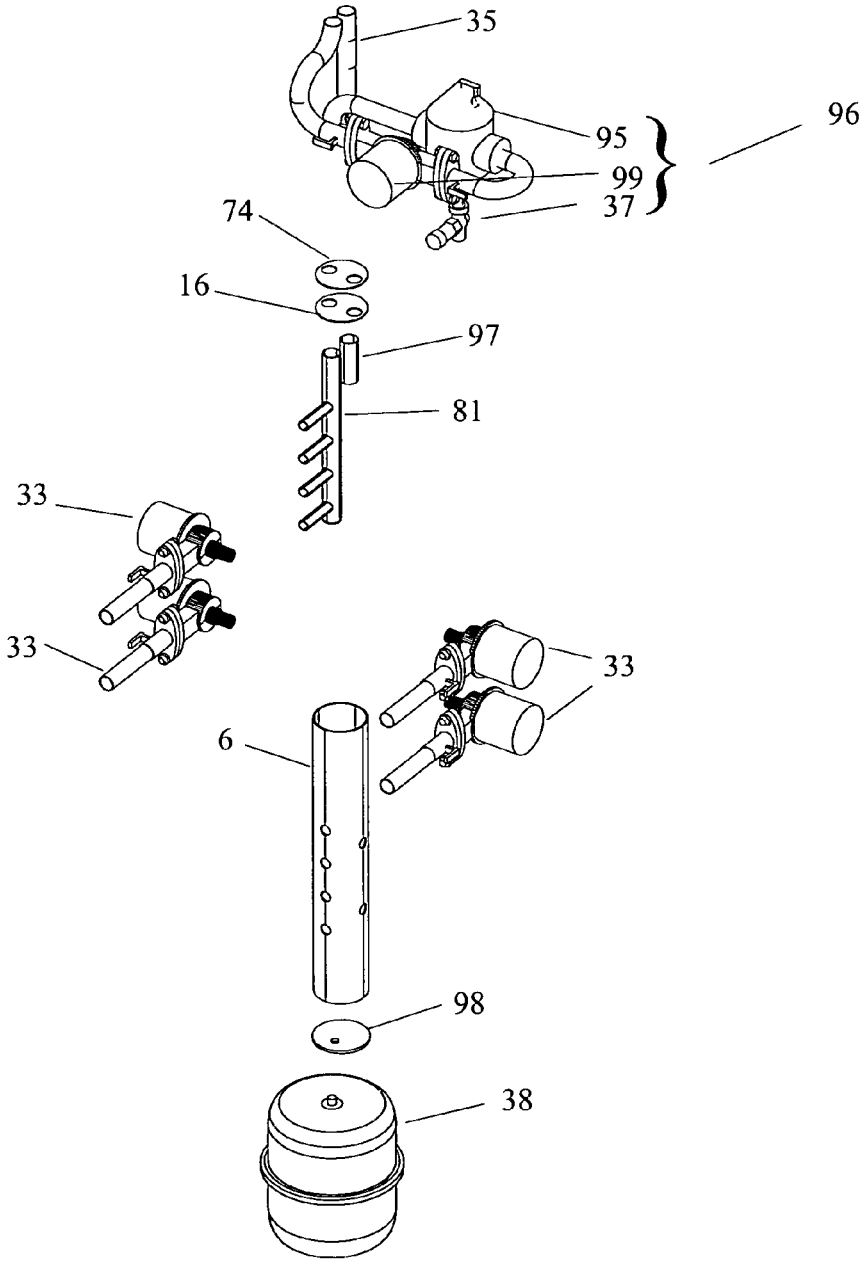
Figure 17:
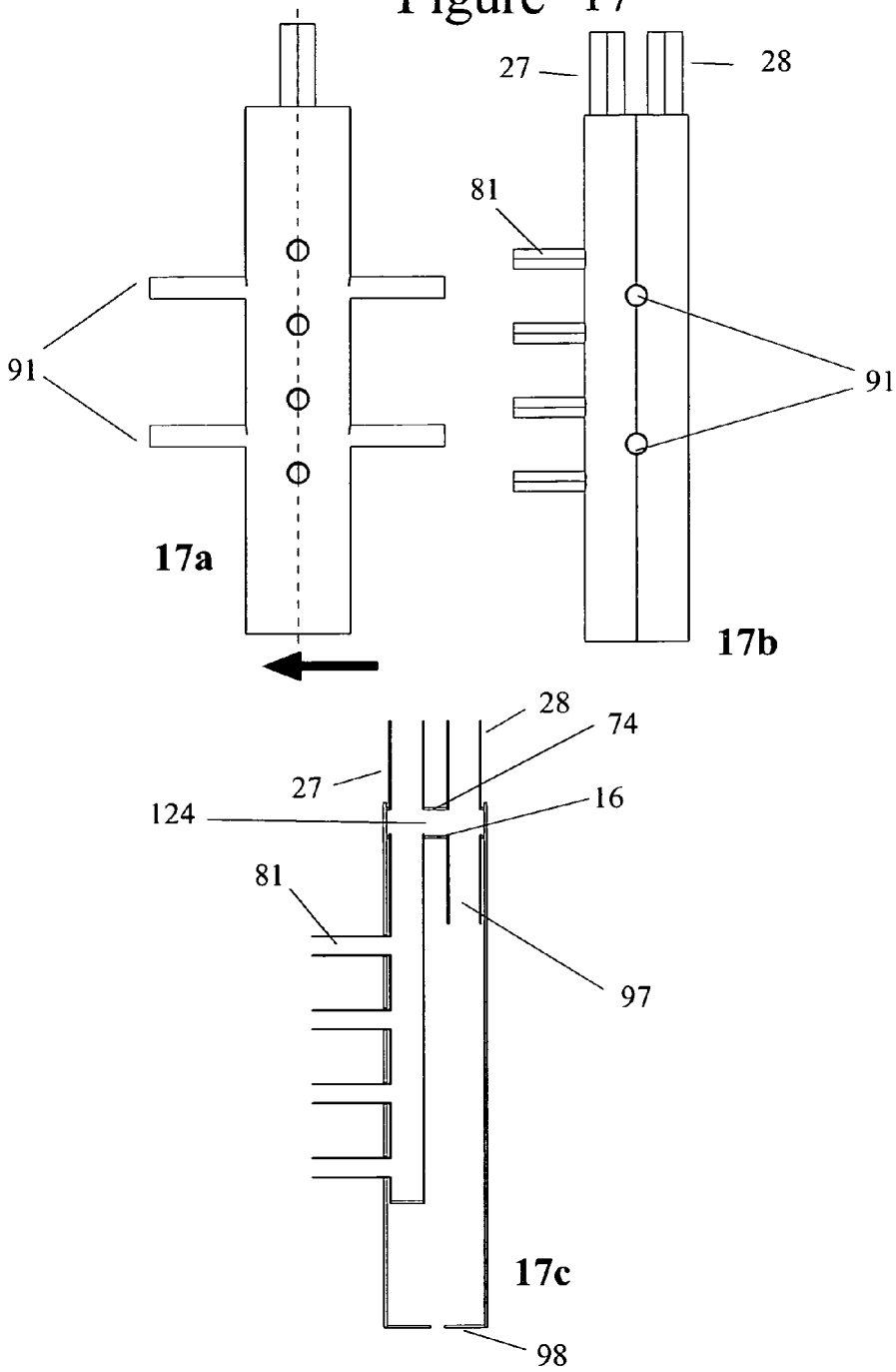
Figure 18:
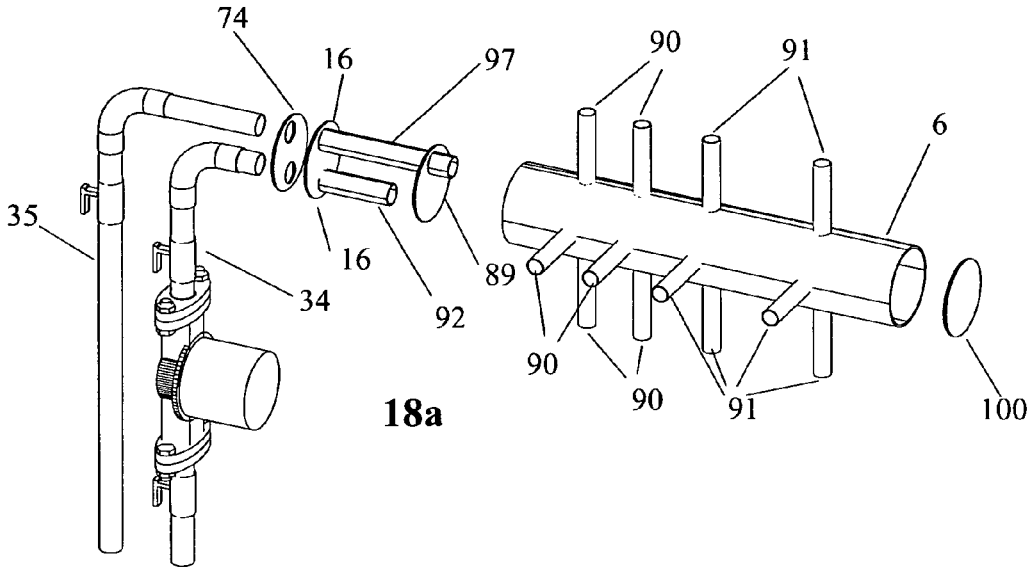
Figure 18:
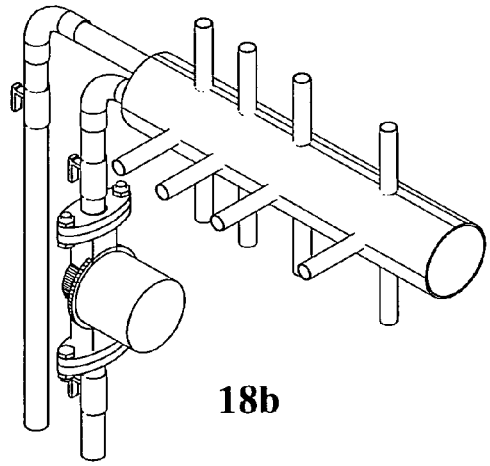
Figure 19:
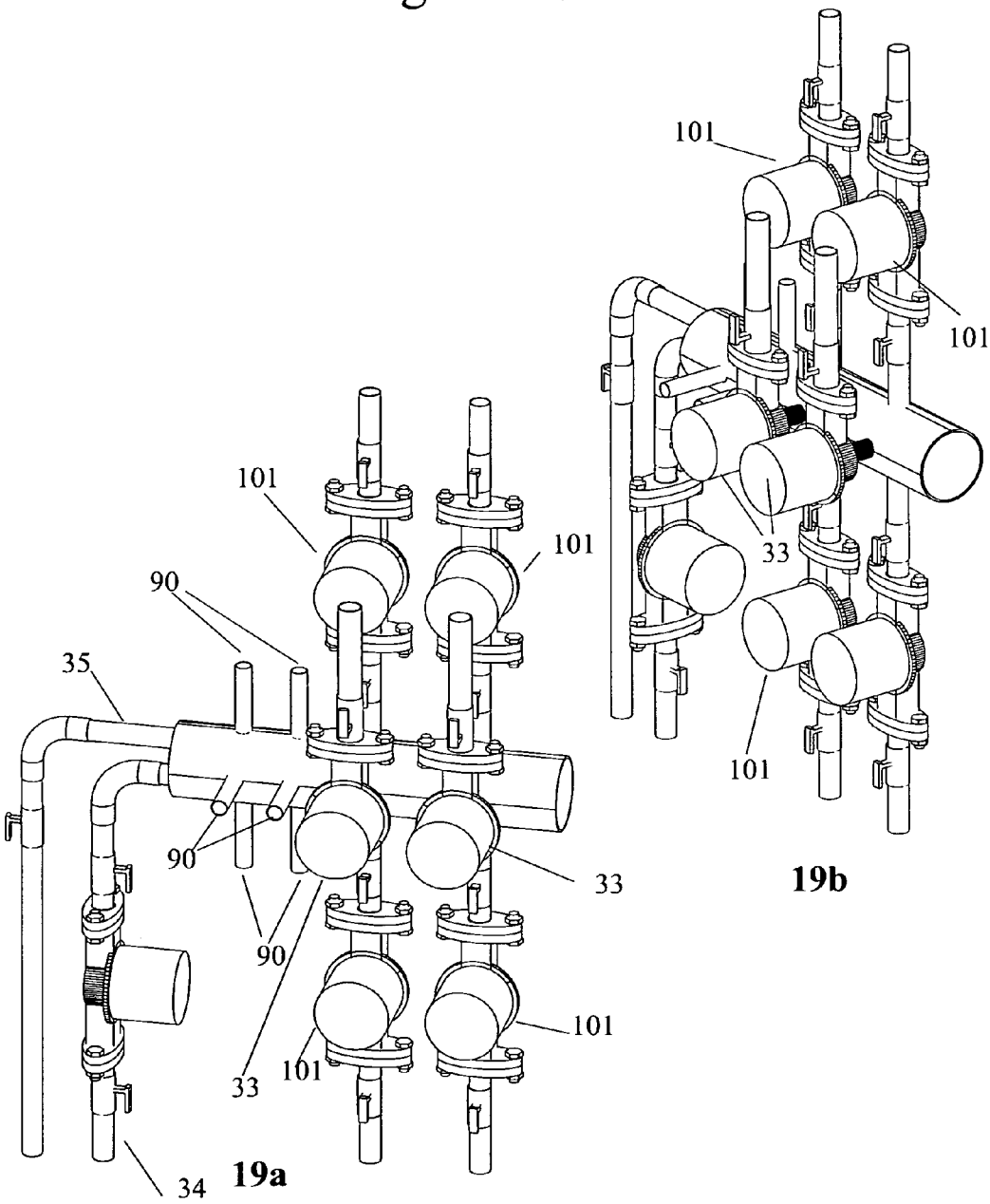
Figure 20:
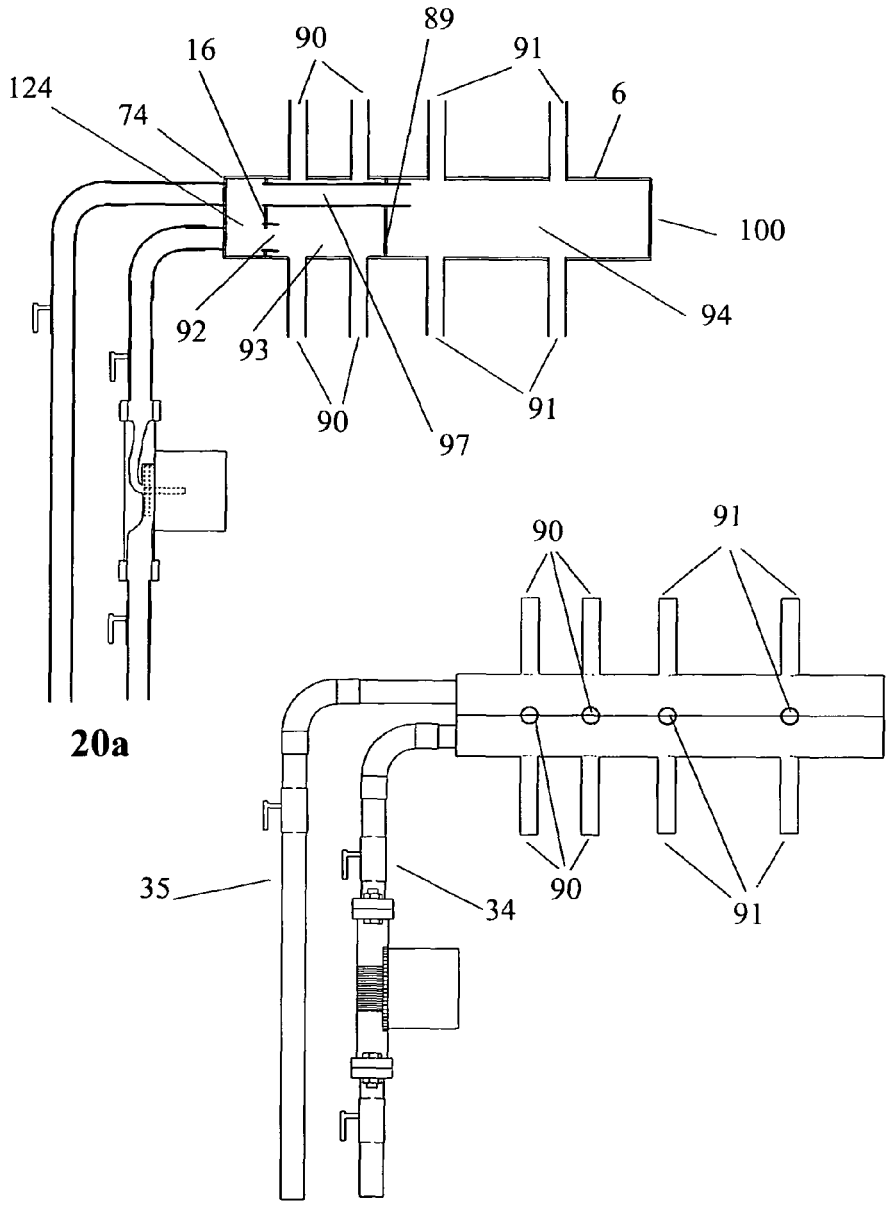
Figure 21:
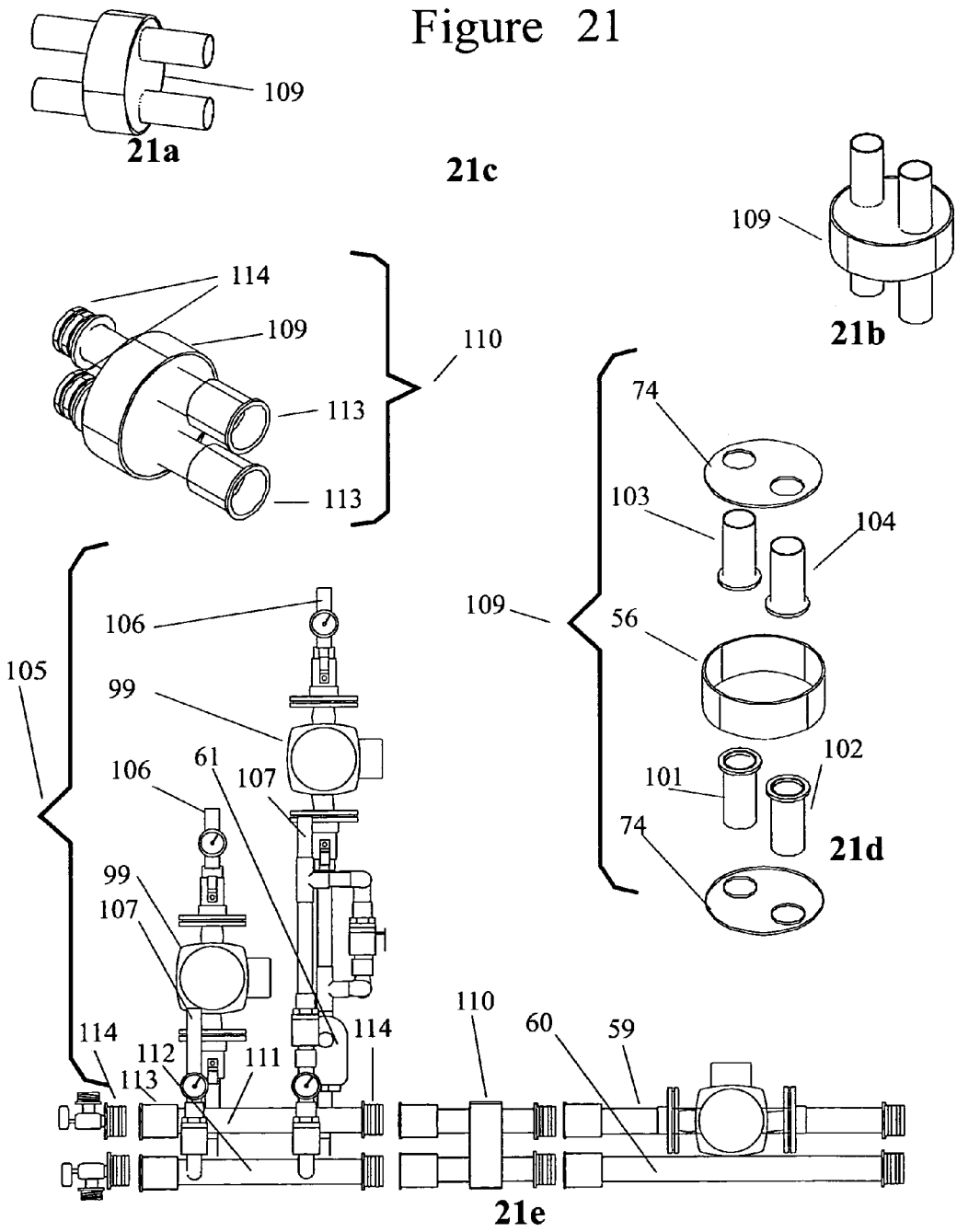
Figure 22:
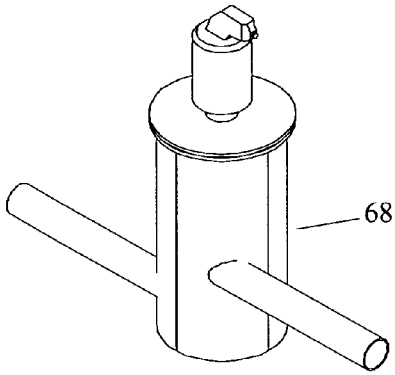
Figure 22:
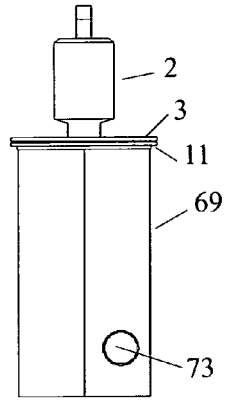
Figure 22:
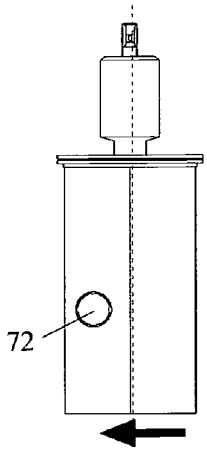
Figure 22:
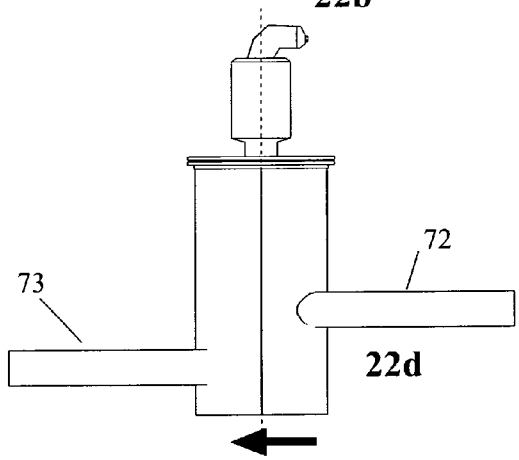
Figure 22:
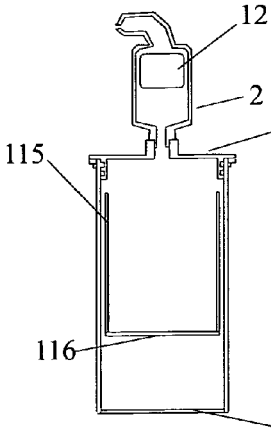
Figure 22:
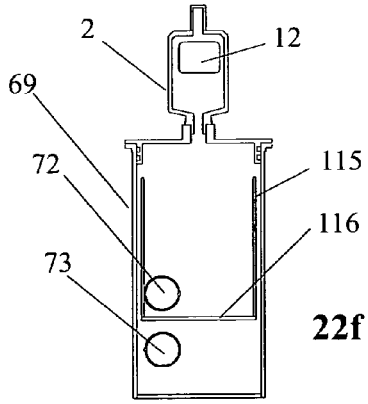
Figure 23:
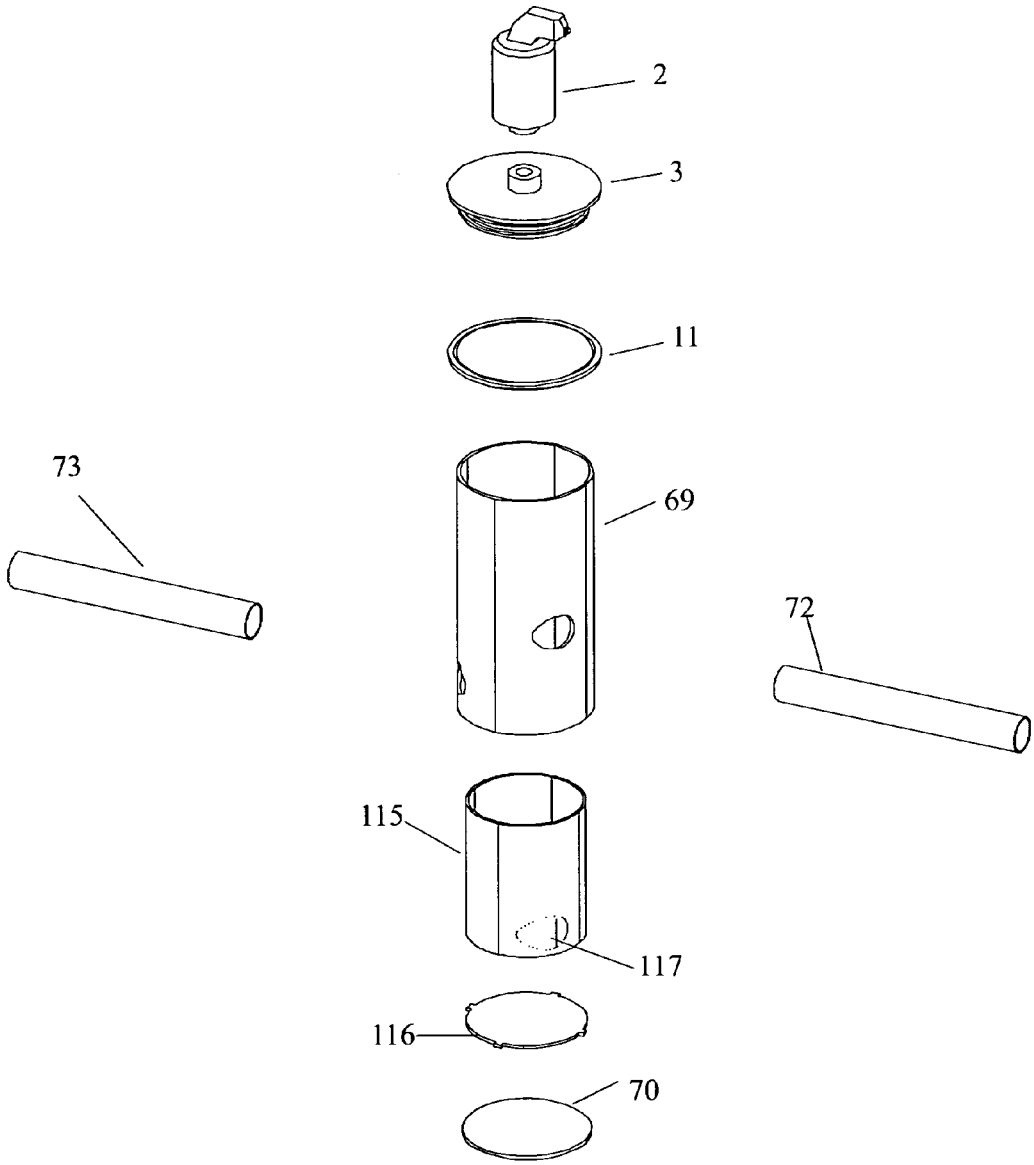
Figure 24:
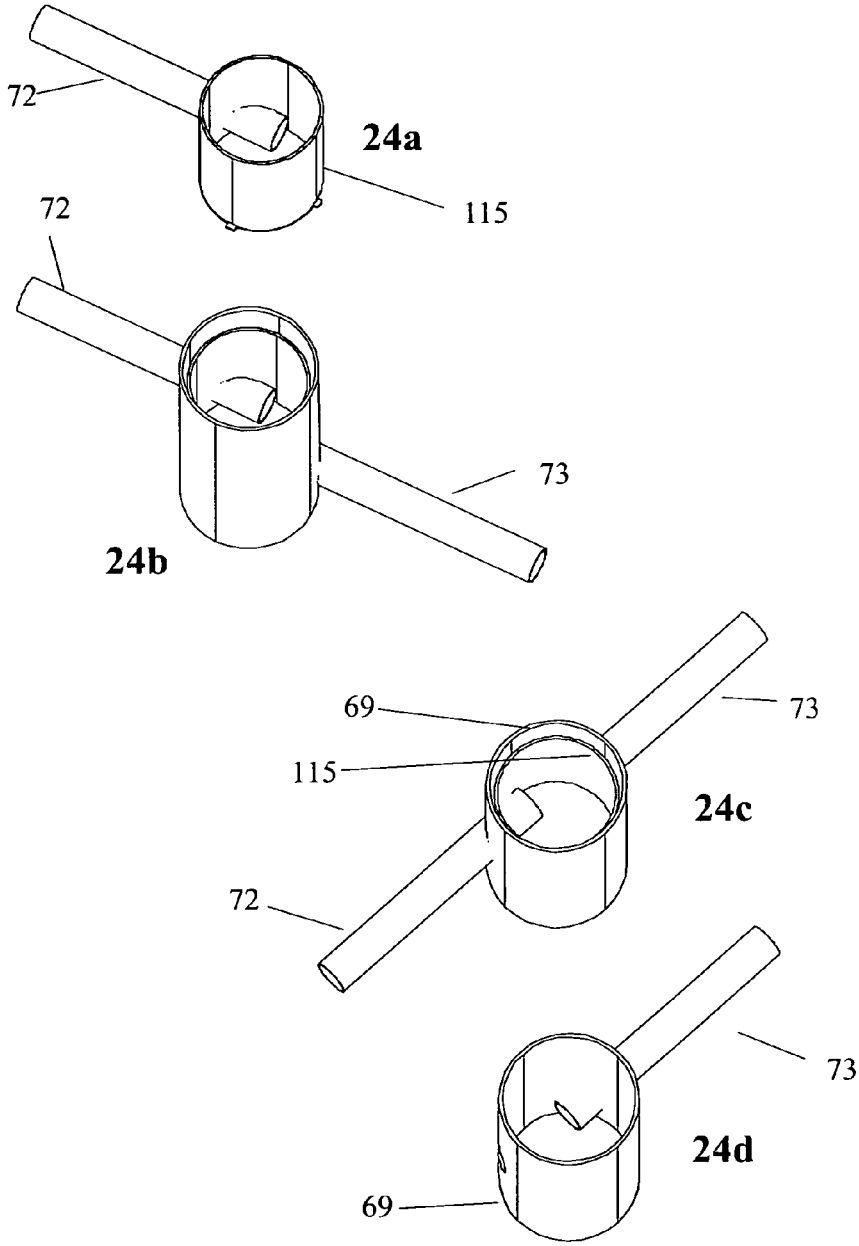
Figure 25:
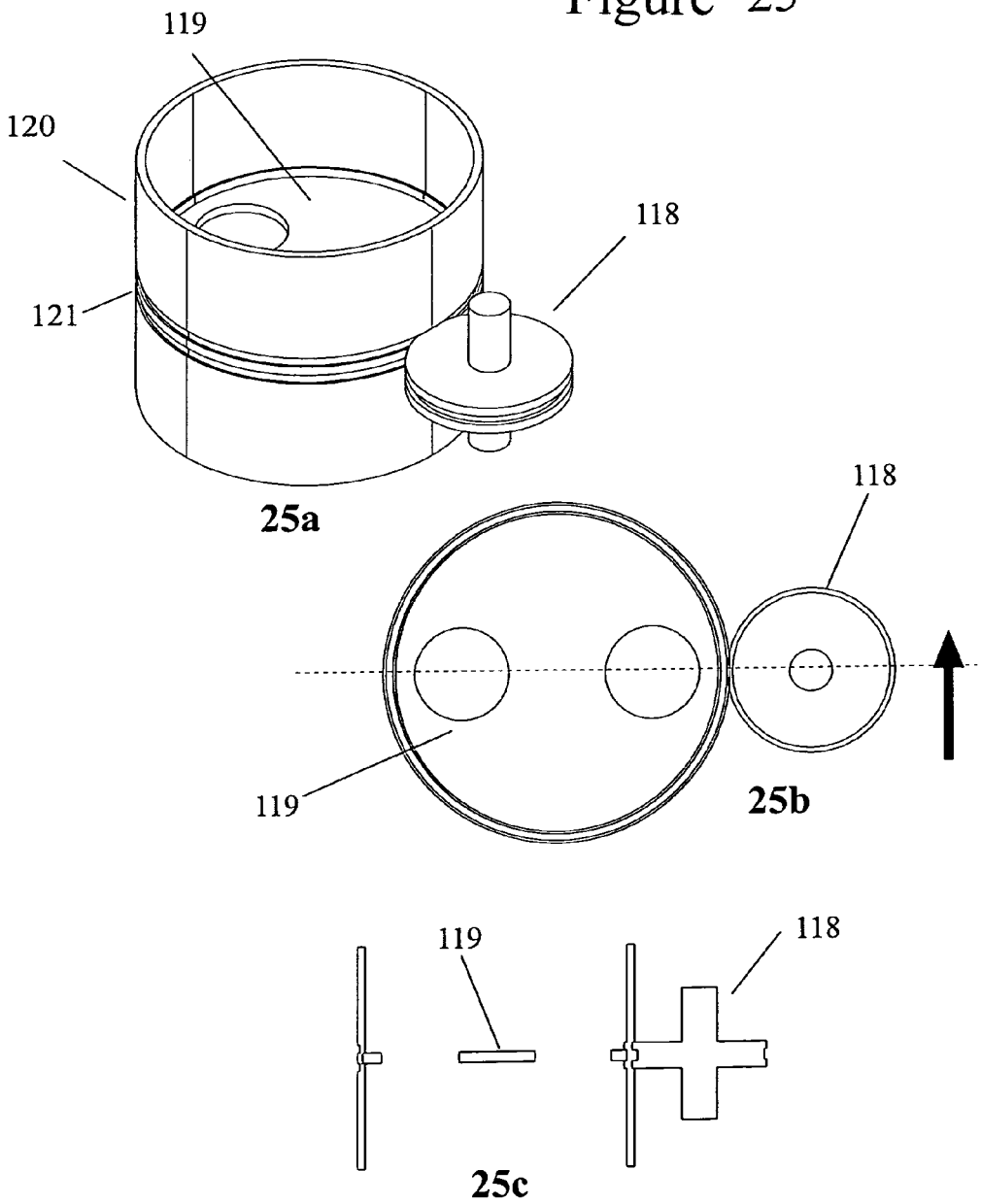
Figure 26:
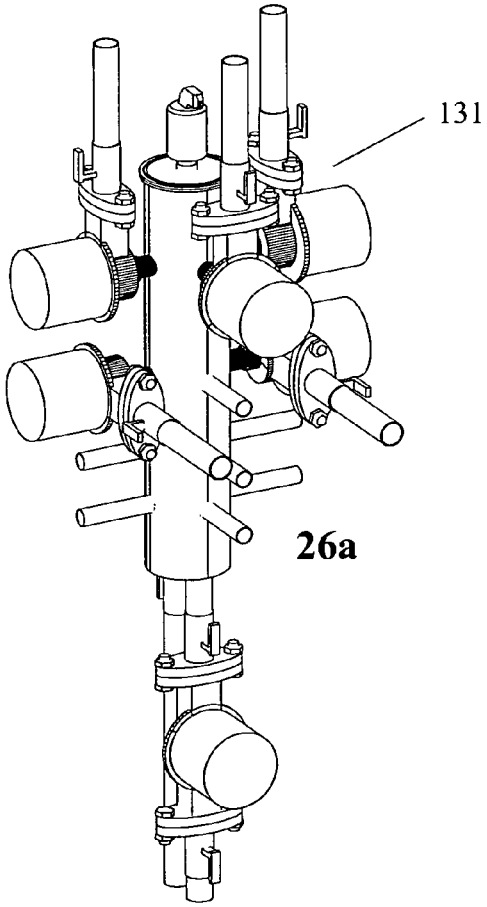
Figure 26:
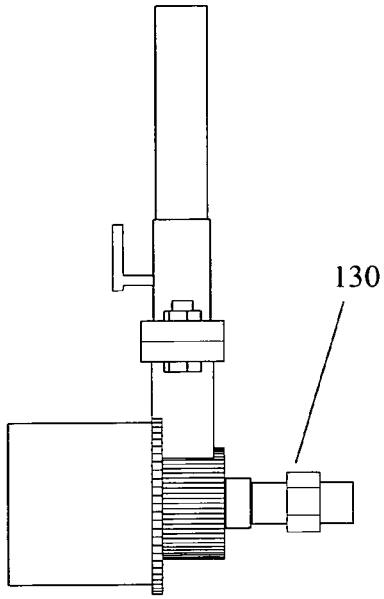

1a
front view of Vertically Piped Air Eliminator

1c
Side View of Vertically Piped Air Eliminator

1b
Section of View 1a

18a

18b

20a

20b

22a

22b

22c

22d

22e

22f

26a

26b

HYDRONIC ASSEMBLY OF MANIFOLD WITH HYDRAULIC SEPARATOR AND ENDSUCTION PUMPS

BACKGROUND

Hydronic heating systems require a "mechanical space" for the central equipment. Mechanical spaces in the past were large spaces since the boilers they contained were large and needed to be accommodated. As a result, a considerable amount of wall space was typically available to mount mechanical components in a linear sequence. New, very small, condensing boilers have entered the market and created a need to make smaller, space saving hydronic mechanical modules to fit in small mechanical spaces.

The new boilers work best with hydraulic separation of flow between a primary piping loop and secondary loops that go to heating zones so that the primary loop can be predictably designed to provide the necessary flow for the boiler heat exchanger and to overcome the often high resistance to flow of such specialized heat exchangers.

If the components are piped conventionally and mounted on the wall, this takes up a great deal more space than the boiler which if installed alone would only require a very small space. The wasteful use of a large space in conventional hydronic mechanical rooms is costly in that the components themselves are costly, as is the cost per square foot to construct the large mechanical space to accommodate it. Thus a need has arisen for much more compact and cost effective components and modules for use in hydronic heating systems.

Hydraulic separation components have been constructed largely in the field with the use of closely spaced "Tees". Hydraulic separators with a hydraulic separation chamber have been available in the past but they have not been made from inexpensive piping materials and methods or included a quality air elimination device or with specific thought in how to port them with space saving end suction pumps to save space for use with the new very small condensing boilers.

Previous air eliminators have been designed separately to be mounted in line with a single ingoing and outgoing pipe and have been predominantly made from cast parts. The use of closely spaced Tees to hydraulically separate the primary and secondary loops of a hydronic system have been employed before, and hydraulic separators have taken various forms but have not been integrated with a high quality air elimination system using the principles of change of volume, direction, rotation, and/or change in pressure to precipitate air from the hydronic fluid.

SUMMARY OF THE INVENTION

This invention is an improvement in that the components can be made from cost effective piping materials. Several components are combined into one compact unit. In one embodiment, this unit replaces numerous components that are normally installed separately on a wall with one centralized, module that serves multiple functions, combines a high quality air separation device with a hydraulic separator, pumps, supply and return ports in a compact format that eliminates numerous separate field installed components and connections.

In various embodiments, the invention can be cost effectively made predominantly by means of spun, bent, pressed, bored, milled sheet copper or brass sheet, copper or brass tube or rod utilizing brazing, soldering and threading of parts. Additionally, these embodiments can serve as a transition adaptor to other modular mechanical components by means of a shared commonality of pipe sizes, spacing and fitting systems.

The invention will significantly improve hydronic practice by making for more compact installations with fewer chances for installer error. The invention can be combined with other normal hydronic items to form a larger and very compact module. Furthermore it can be made from readily available materials and will be easy to clean and maintain. Additionally many of the parts can be used interchangeably to manufacture a wide range of variants with significant resulting cost savings.

In one aspect, the invention is a hydronic manifold with coupled secondary loop pumps that takes advantage of the compactness of end suction pumps. The assemblage comprises a manifold having a primary inlet, a primary outlet, a plurality of secondary loop outlets, and a plurality of secondary loop inlets, wherein at least two of the secondary loop outlets are respectively coupled to at least two inlets of centrifugal pumps, and each secondary loop outlet and coupled pump inlet are oriented along an axis of a rotational impeller in the pump.

Installation instructions instructing that the assembly should be installed with the axis of each rotational impeller oriented horizontally with respect to gravity may be included. Each centrifugal pump has an outlet that is oriented within a plane and this plane may be perpendicular to the axis of the impeller of the pump. Each centrifugal pump may be coupled to the manifold via its inlet with an inlet coupling that can be secured in a plurality of orientations by rotating the pump with respect to the manifold.

In another aspect, the invention is a hydronic manifold adapted for compact installations. The manifold includes a primary loop inlet, a primary loop outlet, a plurality of secondary loop outlets, and a plurality of secondary loop inlets. At least two secondary loop outlets are on a first side of the manifold and at least two secondary loop outlets are on a second side of the manifold, and these at least four secondary loop outlets define a plane. At least two secondary inlets are directed parallel to each other and at 90 degrees to the plane, which allows for compactness.

The hydronic manifold may further comprise a hydraulic separation chamber that directly couples the primary loop inlet to the primary loop outlet such that water can flow from one to the other without inducing a flow through a secondary loop. An outer wall of the manifold may extend to form an outer wall of the hydraulic separation chamber. In addition, an air eliminator may be coupled to the manifold wherein an outer wall of the manifold extends into an outer wall of the air eliminator.

In another aspect, the invention is a hydraulic separator made of a section of pipe by cutting a section of pipe; coupling end fittings to ends of the pipe section and cutting holes in the pipe section and/or end fittings such that the pipe section with end fittings has a primary loop inlet, a primary loop outlet, and a plurality of secondary loop ports and forms a hydraulic separation chamber that directly couples the primary loop inlet to the primary loop outlet such that water can flow from the primary loop inlet to the primary loop outlet without inducing a flow through an open secondary loop port. The primary loop inlet and the primary loop outlet may be oriented parallel to each other at a standard distance and with standard fittings such that the inlet and outlet will mate with other hydronic components having a mating inlet and a mating outlet conforming to the standard.

In another aspect, the invention is a manifold with hydraulic separation made of a section of pipe by cutting a section of pipe; cutting holes in the pipe section and coupling fittings to ends of the pipe section such that the pipe section has a primary loop inlet, a primary loop outlet, and a plurality of secondary loop ports. The pipe section includes a hydraulic separation chamber that directly couples the primary loop inlet to the primary loop outlet such that water can flow from the primary loop inlet to the primary loop outlet without inducing a flow through an open secondary loop port. An outer wall of the manifold may extend to also form an outer wall of an air eliminator. A smaller diameter pipe may be installed inside the pipe section to carry water between the hydraulic separation chamber and an end of the pipe section.

In another aspect, the invention is a manifold with air eliminator made of a section of pipe by cutting a section of pipe; cutting holes in the pipe section or coupling fittings to ends of the pipe section such that the pipe section has a primary loop inlet, a primary loop outlet, and a plurality of secondary loop ports; with an outer wall of the manifold extending to also form an outer wall of an air eliminator coupled to the manifold such that water flows between the manifold and the air eliminator. A smaller diameter pipe may be installed inside the pipe section to carry water between the air eliminator and an end of the pipe section.

In another aspect, the invention is an air eliminator with hydraulic separation made of pipe section by cutting a section of pipe; cutting holes in the pipe section and coupling fittings to ends of the pipe section such that the pipe section has a primary loop inlet, a primary loop outlet, a secondary loop inlet, and a secondary loop outlet all coupled to a hydraulic separation chamber within the pipe section; wherein the pipe section extends to also form an outer wall of an air eliminator which is coupled to the hydraulic separation chamber. A smaller diameter pipe may be installed inside the pipe to carry water between the hydraulic separation chamber and the air eliminator.

In another aspect, the invention is a method of making an air eliminator or an air eliminator plus hydraulic separator by making a hydronic air eliminator upper portion that is complete except for lower components and, for completion of lower components, selecting one of: (i) coupling the upper portion to a hydraulic separation chamber with a primary loop inlet, a primary loop outlet, a secondary loop inlet, and a secondary loop outlet; or (ii) coupling the upper portion to one and only one inlet and to one and only one outlet. The air eliminator plus a hydraulic separator may be formed within a single pipe section cut from a length of pipe.

In another aspect, the invention is a swirling air eliminator (air and water separator). It is formed with an inlet passage directed tangentially into an inner swirl chamber which has a cylindrical wall, an enclosed bottom, and an open circular top. An outer cylindrical swirl chamber surrounds the circular top with an annulus gap between it and the circular top. A water outlet passage is coupled to the outer swirl chamber. An air outlet venting a space sits above the inner chamber and its circular top.

The swirling air eliminator may be combined with a hydronic manifold coupled to the air eliminator wherein the second cylindrical wall of the air eliminator extends to also form a cylindrical outer wall of a manifold. In addition, a hydraulic separation chamber may be added such that the second cylindrical wall of the air eliminator extends into the cylindrical outer wall of the manifold and into a cylindrical outer wall of the hydraulic separation chamber.

Each of the aspects of the invention described above may be adapted to work with modular hydronic components that have a standard mating system. In this case, the primary loop inlet and primary loop outlet will be parallel to each other at a standard distance and with standard fittings such that the inlet and outlet will mate with other hydronic components having a mating inlet and a mating outlet conforming to the standard. Secondary loop inlets and outlets may also conform to the standard.

Each aspect of the invention may be made from formed, bent, brazed, induction welded, soldered or milled copper brass or other metal sheet or tube that lends itself to easy manufacture without cast parts, preferably materials normally approved for potable water use such as copper tube and sheet, lead free solder and brazing compounds, low lead or treated brass or stainless steel, and rubber gaskets approved for potable water use.

BRIEF DESCRIPTION OF THE ILLUSTRATIONS

Illustrations 1 and 2 shows a vertically piped air eliminator (air separator).

Illustrations 3, 4 and 5 show an air eliminator combined with a hydraulic separator.

Illustrations 6, 7, and 8 show a multi zone secondary loop.

Illustrations 9 and 10 show a variation of the module shown in Illustrations 6 and 7.

Illustrations 11, 12 and 13 show an embodiment similar to Illustrations 6, 7, and 8.

Illustrations 14, 15, 16 and 17 show an embodiment similar in construction to Illustration 6, while Illustrations 18, 19, and 20 show the same components but with a horizontal orientation of the primary chamber.

Illustration 21 shows a simple hydraulic separator.

Illustrations 22, 23 and 24 show a simple horizontally ported air eliminator 68.

Illustration 25 shows a simple way of pressing plates into a cylindrical canister, and Illustration 26 shows the convenience of being able to rotate end suction pumps upward.

DETAILED DESCRIPTION

In the following detailed description of exemplary embodiments of the invention, reference is made to the accompanying drawings. The detailed description and the drawings illustrate specific exemplary embodiments by which the invention may be practiced. Other embodiments may be utilized, and other changes may be made, without departing from the spirit or scope of the present invention. The following detailed description is therefore not to be taken in a limiting sense, and the scope of the present invention is defined by the stated claims.

Illustrations 1 and 2 show a vertically piped air eliminator 1 made from cylindrical materials and plates or caps. It may be incorporated also into other embodiments integrated into a bigger multifunctional canister. Fluid goes up the supply pipe 4, until it reaches the supply pipe orifice 14 where the fluid is redirected to the outside wall of the swirl chamber 9. The swirl chamber wall 9 is attached to the swirl chamber bottom 8 and the supply pipe by brazing, soldering, threading or other conventional means. The fluid is directed to rotate in the swirl chamber. The principles of change of volume, direction, rotation, and/or change in pressure precipitate and direct air from the hydronic fluid at the top to the air vent 2. From there the fluid rotates downward between the outside of the swirl chamber wall 9 and the inside of the canister wall 6 to reach the return chamber. From there it exits down the return pipe 5.

In assembling the unit 1 shown in Illustrations 1 and 2, the supply pipe 4 is brazed, soldered, threaded or otherwise attached to the swirl chamber bottom 8 and then the swirl chamber wall 9 is brazed, soldered, threaded or otherwise attached to the swirl chamber wall 9 forming an assembly 21 which is then similarly attached to the bottom two holed plate 7 and the return pipe 5 is brazed, soldered, threaded or otherwise attached to the bottom two holed plate 7. This assembly is then placed up inside the canister (made from a cut section of pipe) and the bottom two holed plate is brazed, soldered, threaded or otherwise attached to the canister wall 6. A lid 3 is fitted to the top either as a soldered, brazed, or otherwise joined with a flange 11 or as threaded or insert cap with O-ring 10. The lid 3 provides attachment for a float or other style air vent 2.

Illustrations 3, 4 and 5 show incorporating an air eliminator working on similar principles such as described above but additionally incorporating a hydraulic separator and secondary loop supply and return lines. In this embodiment, a primary loop supply pipe 27 and a primary loop return pipe 28 are brazed, soldered threaded or otherwise joined to the separator outer plate 74. The inner separator divider 16 is similarly joined to the canister wall 6. The secondary return manifold 25 is inserted and joined to the canister wall 6 before the other parts. The inner separator divider 16 is joined to the inner wall of the canister 6, which is joined to the air eliminator supply pipe 4. The air chamber supply pipe 4 is joined to the swirl chamber bottom 8. Note that the swirl chamber bottom may have alignment tabs as shown. The secondary loop supply pipe 26 is joined to the canister wall 6. The unit is fitted with a lid 3 and an air vent 13 usually with a float mechanism 12 for releasing air.

Fluid enters from the primary loop supply pipe 27 and may either return by the primary loop return pipe 28 or be drawn up the swirl chamber supply pipe 4 and then it is redirected by the swirl chamber supply pipe orifice against the swirl chamber wall 9. The fluid is directed to rotate in the swirl chamber. The principles of change of volume, direction, rotation, and/or change in pressure precipitate and direct air from the hydronic fluid at the top to the air vent 2. From there the fluid rotates downward between the outside of the swirl chamber wall 15 and the inside of the canister wall 6 to reach the return chamber. From there it will flow out the secondary loop supply pipe 26 and return by means of the secondary loop return pipe 25 to the hydraulic separation chamber 124. From there, when there is a higher flow rate in the primary loop, the fluid will be directed down the primary loop return pipe 28. If there is a higher flow rate in the secondary loop, then some of the fluid from the secondary loop return pipe 25 will be directed up the swirl chamber supply pipe 4 and some back to the primary loop return pipe 28. This feature can be used to control water temperature in the secondary loops by controlling the amount of cooled secondary loop return water that is mixed with primary loop supply water. The hydraulic separation chamber allows the pressure differences between the supply and returns to equalize and prevents the inducing of ghost flows.

Illustration 5 shows the embodiment of Illustration 3 and 4 but with an end suction centrifugal pump 33 attached to the canister 6 instead of the secondary loop supply pipe 26 and with the addition of pump and shut off valves on the primary loop return 34 and a longer pipe and shut off valve on the primary loop supply 35. This embodiment shows how primary and secondary loop pumps, a hydraulic separator and a quality air eliminator may be made in a space saving, compact format.

Since the impeller shafts of wet rotor pumps must be kept horizontal, the end suction pump offers a significant advantage over conventional pumps in combination with a cylindrical vertical canister. The pumps may be easily swiveled to face straight out as shown or up, down or in between and the ports for such pumps may be located anywhere on the circumference of the canister. Conventional straight through pump flanges and pumps may be used with this invention but they will take up a great deal more space and may not be swiveled to alternate orientations and do not lend themselves to flexible on the job alterations of pump orientation. Being able to alter the pump orientation easily on the job site, where heating zones may be located in different directions, is a huge time saving benefit and reduces piping and installation costs.

Illustrations 6, 7 and 8 show a multi zone secondary loop module similar to the one described immediately above but with differences that the secondary loop return pipe 81 is now a multi ported manifold that is inserted from inside the unit through holes 80 and joined to the canister wall 6, the canister 6 has been lengthened, the swirl chamber supply pipe 4 has been lengthened, and multiple secondary loop supply pipes 79 have been added, as well as hanging bracket 39, expansion tank 38, fill valve 37, fill pipe 75, and a fill water port 78 on the canister 6. Fill water pipes would be field connected to the fill water connection end 77 of the fill valve. The entire fill water assembly 76, which includes the fill pipe, expansion tank and pressure reducing fill valve are joined to the canister 6 at the fill port 78. In Illustrations 6 and 7, end suction pumps 33 are shown joined to the canister instead of the secondary loop supply pipe 26 shown in Illustration 8 of the same embodiment.

Illustrations 9 and 10 show a variation of the module shown in Illustrations 6 and 7, where the primary loop supply and return have been adapted to fit under a small wall hung boiler. The primary loop supply pipe with shut off valve 35 and the primary loop return pipe with pump and shut off valves 34 are piped down from the canister 88 but then turn upward towards the boiler 82. The primary loop supply line 35 shows a tap 85 for supply to an indirect water tank. The primary loop return pipe 34 shows an additional pump with shut off valves 84 joined into it for a return from an indirect water tank, as well as additional air purge bleeder valve 83. The boiler supply pipe 86 connects to the module primary loop supply 35 and the boiler return pipe 87 connects to the primary loop return pipe 34.

Since boilers come ported in many ways top, left side, right side, bottom or a combination, the primary loop supply pipe and shut off 35 and primary loop return with pump and shut off valves may be modified to many possible shapes and could include additional standard hydronic components such as gauges, strainers and low water cut off valves. The primary loop supply 35 and return 34 might reverse the location of the pump from supply to return and need not have shut off valves. In some cases the primary loop pump may be deleted, for example if the boiler already contains an integral pump.

Illustrations 11, 12 and 13 show an embodiment similar to that shown in Illustrations 6, 7, and 8, with the difference that the multiported secondary loop return manifold 81 shown in Illustration 7 has been replaced by using a return chamber 93 that is made by joining the supply/return divider 89 to the canister wall and the air swirl chamber supply pipe 4 with directional opening 13. In this and other embodiments secondary loop supply pipes 91 are shown in three directions but may be in fact be located anywhere on the circumference of the canister 6 as long as they have access to the supply chamber 94. Likewise the secondary loop return pipes 90 may be located anywhere around the circumference of the canister provided they have access to the return chamber 93. End suction pumps 33 or conventional pumps may be attached anywhere in place of secondary loop pipes and, if end suction pumps, may be swiveled by means of a union flange in any direction to facilitate fast installation.

Illustrations 14, 15, 16 and 17 show an embodiment similar in construction to Illustration 6 but where the canister has been turned upside down, putting the hydraulic separator on top of the canister. The air eliminator has been moved and a horizontally piped air eliminator 95, either conventional or as shown in Illustrations 1 and 2, has been incorporated into the primary loop return assembly 96. The primary loop return assembly consists of the following piped together parts: an air eliminator 95, a pump with or with out shut offs 99 and a fill valve 37. Other normal hydronic components might be added. The primary loop supply pipe 35 normally would have a shut off valve. Additional standard hydronic components such as gauges, strainers and low water cut off valves may be added to the primary loop return assembly 96 or the primary loop supply 35. The primary loop supply 35 and return assembly 96 might reverse the location of the pump from supply to return and need not have shut off valves. In some cases the primary loop pump may be deleted, for example if the boiler already contains an integral pump.

Illustration 14 shows the embodiment with end suction pumps 33 and an expansion tank 38 attached to the bottom of the canister 98 which is joined to the canister wall 6. The design includes a shortened secondary loop supply pipe 97 and a multiport secondary loop manifold 81, both joined to the inner separator divider 16. The inner separator divider 16 and the separator outer plate 74 are both joined to the canister wall 6. The primary loop supply pipe assembly 35, shown more simply as 28, attaches to the separator outer plate 74 and to the supply from the boiler 44. The primary loop return assembly 96 attaches to the outer plate assembly 74 and to the return of the boiler 44.

Fluid moves from the boiler to the supply pipe 35 to the separation chamber 124 down the supply pipe 97, is drawn out by the pumps 33, returned to the secondary loop manifold 81 and back to the boiler through the separation chamber 124 to the return pipe 27 or return assembly 96 back to the boiler 44. In this design and all embodiments using the hydraulic, separator, flow paths may vary to include mixing of primary and secondary loop water, dependent on flow rates as previously described above. Pumps 33 may be attached to where the secondary loop supply pipes 91 are shown.

Illustrations 18, 19 and 20 show a horizontal embodiment using a separate supply chamber 94 and return chamber 93. Fluid flows through the primary loop supply pipe 35 enters the separation chamber 124 which is formed between the outer plate 74 and the separator inner divider plate 16, then flows up the supply pipe 97 to the supply chamber 94, is drawn out by any of the secondary loop supply pipes 91, returns to the secondary loop return pipes 90, to the return chamber 93, to the return pipe 92, back through the hydraulic separation chamber 124 to the primary loop return pump and assembly 34. In this design and all embodiments using the hydraulic separator, flow paths may vary to include mixing of primary and secondary loop water, dependent on flow rates as previously described above.

Pumps, either end suction 33 or conventional 101 may be attached to where the secondary loop supply pipes 91 are shown. Illustration 19 shows a version with both end suction and conventional pumps. The assembled canister is built by joining the return pipe 92, the supply pipe 97 to the separator inner plate 16 and the supply return chamber divider 89. Once joined, these are inserted into the canister and joined to the canister wall 6. Secondary loop return pipes 90 and secondary loop supply pipes 91 are joined to the canister wall 6. Then the end cap 100 and the outer separator plate 74 are joined to the canister. The primary loop supply 35 and primary loop return 34 may then be joined to the outer separator plate 74.

Illustration 21 shows a simple hydraulic separator-made from the same parts as the canisters and, that when combined with modular fittings, will serve as an efficient way to connect modular primary and secondary loop parts. Illustrations 21*a* and 21*b* show the simple separator made as shown in Illustration 21*d* from two separator outer plates 74 joined to primary loop supply pipe 101 and primary loop return pipe 102 on one side and to the secondary loop supply 103 and the secondary loop return pipe 104 with the two plates 74 joined to a short pipe section 56. Illustration 21*c* shows an assembled separator 110 with male 114 and female 113 modular fittings joined to the simple separator 109.

Illustration 21*e* shows how modular secondary and primary loop parts may be attached. A primary loop supply pumping module 59 pumps water to the separator and the primary loop return module 60 returns it. A multi pump secondary loop module 105 is comprised of in this case a simple pumping station plus a pumping station with a two way valve. Secondary loop supply water flows from the modular separator 110 through the modular fitting 114 to the secondary branch supply pipe 111, in the case of the simple pumping station, out through the pump 99 via outlet 106 and back to the secondary loop return 107 to the secondary loop branch return pipe 112, back to the modular separator 110, and back to the primary loop return pipe 60. In the case of the two way valve, fluid flows from the secondary loop supply branch 111 through the two way valve 61, is blended with return water from the secondary loop return pipe 107 and is pumped out by the pump 99 via its outlet 106, returns to the secondary loop return 107 where what is not blended to the two way valve returns to the return branch manifold 112.

Illustrations 22, 23 and 24 show a simple horizontally ported air eliminator 68 made from simple parts. Fluid flows in through the supply pipe 72 and is directed against the swirl chamber wall 115, swirls up and over the swirl chamber wall 115 and, due to change of direction volume and pressure, releases air upward towards the lid 3 and out the air vent 2. Fluid then goes down between the swirl chamber wall 115 and the canister wall 69 and exits to the return pipe 73. The unit is constructed by inserting the supply pipe 72 through the outer canister wall 69 and through the opening 117 in the swirl chamber wall 115. The supply pipe 72 is then joined to the swirl chamber. The swirl chamber bottom 116 is then joined to the swirl chamber side 115, then the supply pipe 72 is joined to the canister wall 69, then the canister bottom 70 is joined to the canister wall 69, and then the return pipe 73 is joined to the canister wall 69. The unit is then fitted with a flange 11 and a lid 3 containing an air vent 2.

This invention lends itself to many embodiments using the same cost effective parts such as the plate 119 shown in Illustration 25. These parts may be joined by soldering, threading, brazing, spinning or pressing. Illustration 25 shows a simple way of pressing the plates into a cylindrical canister 120 using a pressing wheel 118 forming indentations 121. The plate may be further joined in place by soldering or brazing.

Illustration 26*a* shows the convenience of being able to rotate end suction pumps upward. A five pump module (131) shows three of the five pumps rotated upward. A union connection (130) to accomplish this is shown in illustration 26*b*.

Applicant reserves the right to copy into this document material contained in the provisional patent application from which this application claims priority. Although the present invention has been described in detail with reference to certain preferred embodiments, other embodiments are possible. Therefore, the spirit or scope of the appended claims should not be limited to the description of the embodiments contained herein. It is intended that the invention resides in the claims hereinafter appended.

What is claimed:

1. A compact assembly of a hydronic manifold with a hydraulic separation chamber and at least one end-suction type secondary loop pump, comprising:

(a) a manifold having a primary loop inlet, a primary loop outlet, one or more secondary loop outlets, and one or more secondary loop inlets, all communicating with the hydraulic separation chamber within the manifold;

(b) the primary loop inlet and the primary loop outlet being parallel to each other at a distance and with fittings for coupling to other hydronic components such that the primary loop inlet and the primary loop outlet will mate with other hydronic components having a mating inlet fixed to a mating outlet, the mating inlet and mating outlet being parallel to each other and conforming to the distance and the fittings;

(c) each of the one or more secondary loop outlets respectively coupled to an inlet of an end-suction type centrifugal pump having an outlet in a plane that is perpendicular to its inlet;

(d) wherein the manifold is configured so that, when mounted alongside a vertical wall, the assembly may be oriented so that (1) the secondary outlets and secondary inlets are directed parallel to the wall or away from the wall but not toward the wall, and (2) each secondary loop outlet and coupled pump inlet is oriented horizontally and parallel to an axis of a rotational impeller in the pump, and (3) the manifold and at least one pump are each alongside the wall such that one could mount the assembly with the manifold and at least one pump at equal distances from the wall.

2. The assembly of claim 1 further comprising installation instructions instructing that the assembly should be installed with the axis of each rotational impeller oriented horizontally with respect to gravity.

3. The assembly of claim 1 wherein, when mounted alongside a vertical wall, the inlet of each centrifugal pump is capable of being oriented parallel to the wall.

4. The assembly of claim 1 wherein each centrifugal pump is coupled to the manifold via its inlet with an inlet coupling having a pump side and a manifold side and each inlet coupling is capable of being secured in a plurality of orientations by rotating the pump side with respect to the manifold side.

5. The assembly of claim 1 wherein a body of the manifold is made from a cut section of pipe.

6. The assembly of claim 1 comprising at least two secondary outlets coupled to at least two pumps.

7. The assembly of claim 6 comprising at least four secondary outlets coupled to at least four pumps wherein the four secondary outlets are configured in a rectangle.

8. The assembly of claim 7 wherein at least one secondary inlet is directed perpendicular to a plane defined by the rectangle and bisecting the plane within the rectangle.

9. A hydronic manifold for compact installations, comprising:

(a) a manifold having a primary loop inlet, a primary loop outlet, at least four secondary loop outlets, and at least four secondary loop, inlets;

(b) wherein at least two secondary loop outlets are on a first side of the manifold and at least two secondary loop outlets are on a second side of the manifold directly opposite the outlets on the first side such that the at least four secondary loop outlets define a rectangle within a plane;

(c) at least two secondary inlets are directed parallel to each other and at 90 degrees to the plane, disposed such that an axis centered in each intersects the plane within the rectangle; and (d) the primary loop inlet and primary loop outlet are parallel to each other at a distance and with fittings for coupling to other hydronic components such that the primary loop inlet and the primary loop outlet will mate with other hydronic components having a mating inlet fixed to a mating outlet, the mating inlet and mating outlet being parallel to each other and conforming to the distance and the fittings.

10. The hydronic manifold of claim 9 further comprising:

(a) a hydraulic separation chamber that directly couples the primary loop inlet to the primary loop outlet such that water can flow from the primary loop inlet to the primary loop outlet without inducing a flow through a secondary loop, wherein an outer wall of the manifold extends to also form an outer wail of the hydraulic separation chamber.

11. A compact assembly of a hydronic manifold with a hydraulic separation chamber, an air vent, and at least one end-suction type secondary loop pump, comprising:

(a) a manifold having a primary loop inlet, a primary loop outlet, one or more secondary loop outlets, and one or more secondary loop inlets, all communicating with a hydraulic separation chamber within the manifold;

(b) an air vent mounted on the manifold;

(c) each of the one or more secondary loop outlets respectively coupled to an inlet of an end-suction type centrifugal pump having an outlet in a plane that is perpendicular to its inlet;

(d) wherein the manifold is configured so that, when mounted alongside a vertical wall, the assembly may be oriented so that (1) the secondary outlets and secondary inlets are directed parallel to the wall or away from the wall but not toward the wall, and (2) each secondary loop outlet and coupled pump inlet is oriented horizontally and parallel to an axis of a rotational impeller in the pump, and (3) the manifold and at least one pump are each alongside the wall such that one could mount the assembly with the manifold and at least one pump at equal distances from the wall.

12. The assembly of claim 11 further comprising a swirl chamber coupled between the air vent and the separation chamber.

13. The assembly of claim 12 wherein the swirl chamber has an outer enclosure made of a section of pipe which section of pipe also forms an outer enclosure of the separation chamber.

14. A compact assembly of a hydronic manifold with a hydraulic separation chamber and at least one end-suction type secondary loop pump, comprising:

(a) a manifold having a primary loop inlet, a primary loop outlet, one or more secondary loop outlets, and one or more secondary loop inlets, all communicating with a hydraulic separation chamber within the manifold;

(b) the manifold having a first pipe inside a second pipe such that secondary flow flows in a first direction in the first pipe that is inside the second pipe and secondary flow flows in the second pipe in a direction opposite the first direction;

(c) each of the one or more secondary loop outlets respectively coupled to an inlet of an end-suction type centrifugal pump having an outlet in a plane that is perpendicular to its inlet;

(d) wherein the manifold is configured so that when mounted alongside a vertical wall, the assembly may be oriented so that (1) the secondary outlets and secondary inlets are directed parallel to the wall or away from the wall but not toward the wall, and (2) each secondary loop outlet and coupled pump inlet is oriented horizontally and parallel to an axis of a rotational impeller in the pump, and (3) the manifold and at least one pump are each alongside the wall such that one could mount the assembly with the manifold and at least one pump at equal distances from the wall.

15. The assembly of claim 14 wherein a body of the manifold is made from a cut section of pipe.

16. The assembly of claim 15 wherein the pipe is made of copper.

17. A hydronic manifold for compact installations, comprising:

(a) a manifold having a primary loop inlet, a primary loop outlet, at least four secondary loop outlets and at least four secondary loop inlets;

(b) having a first pipe inside a second pipe such that secondary flow flows in a first direction in the first pipe that is inside the second pipe and secondary flow flows in the second pipe in a direction opposite the first direction;

(c) wherein at least two secondary loop outlets are on a first side of the manifold and at least two secondary loop outlets are on a second side of the manifold directly opposite the outlets on the first side such that the at least four secondary loop outlets define a rectangle within a plane; and (d) at least two secondary inlets are directed parallel to each other and at 90 degrees to the plane, disposed such that an axis centered in each intersects the plane within the rectangle.

18. The hydronic manifold of claim 17 further comprising:

(a) an air eliminator coupled to the manifold wherein an outer wall of the manifold extends into an outer wall of the air eliminator.

19. The hydronic manifold of claim 17 wherein a body of the manifold is made from a cut section of pipe.

20. The hydronic manifold of claim 11 wherein the pipe is made of copper.

21. The hydronic manifold of claim 17 having at least four secondary inlets directed parallel to each other and at 90 degrees to the plane, disposed such that an axis centered in each intersects the plane within the rectangle.

* * * * *